US007293548B2

(12) United States Patent
Oono

(10) Patent No.: US 7,293,548 B2
(45) Date of Patent: Nov. 13, 2007

(54) HIGH PRESSURE FUEL PUMP CONTROL APPARATUS FOR AN ENGINE

(75) Inventor: Takahiko Oono, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 43 days.

(21) Appl. No.: 11/377,726

(22) Filed: Mar. 17, 2006

(65) Prior Publication Data

US 2007/0079809 A1 Apr. 12, 2007

(30) Foreign Application Priority Data

Oct. 7, 2005 (JP) ..... 2005-294764

(51) Int. Cl.
*F02M 57/02* (2006.01)

(52) U.S. Cl. ..... 123/446; 123/458

(58) Field of Classification Search ..... 123/446, 123/447, 458

See application file for complete search history.

(56) References Cited

U.S. PATENT DOCUMENTS 5,803,049 A * 9/1998 Harcombe ..... 123/446
5,884,606 A * 3/1999 Kellner et al. ..... 123/446
6,142,120 A * 11/2000 Biester et al. ..... 123/456
6,253,734 B1 * 7/2001 Rembold et al. ..... 123/446
6,439,199 B2 * 8/2002 Ramseyer et al. ..... 123/446
6,497,216 B2 * 12/2002 Gaessler et al. ..... 123/450
6,823,845 B2 * 11/2004 Schueler ..... 123/446
6,840,220 B2 * 1/2005 Yomogida et al. ..... 123/456
6,899,083 B2 * 5/2005 Djordjevic ..... 123/446
6,976,473 B2 * 12/2005 Boos et al. ..... 123/446

FOREIGN PATENT DOCUMENTS

JP 08-303325 A 11/1996
JP 2002-188545 A 5/2002

* cited by examiner

*Primary Examiner*—Thomas Moulis
(74) *Attorney, Agent, or Firm*—Sughrue Mion Pllc.

(57) ABSTRACT

A high pressure fuel pump control apparatus for an engine can suppress or avoid uncontrolled fuel delivery of a flow control valve upon delivery of a maximum amount of fuel, and resultant great deterioration in drivability and exhaust gas. An advance angle setting limiting section limits a closed position of the flow control valve from being set to a location advanced from a predetermined advance angle limiting position. A flow control valve control section decides a target pressure in accordance with an engine operating condition, and sets the closed position such that the fuel pressure coincides with the target pressure. When the closed position is being controlled to be limited to the advance angle limiting position, and when the fuel pressure does not show a tendency to coincide with the target pressure, the advance angle limiting position is changed from the last set value to a value more retarded therefrom.

4 Claims, 9 Drawing Sheets

HIGH PRESSURE FUEL PUMP CONTROL APPARATUS FOR AN ENGINE

BACKGROUND OF THE INVENTION

1. Field of the Invention

The present invention relates to a high pressure fuel pump control apparatus for an engine that serves to inject fuel into individual cylinders while controlling the fuel pressure in an accumulator to a target pressure, and more particularly, to a new technique for controlling the delivery of a maximum amount of fuel from a high pressure fuel pump.

2. Description of the Related Art

In recent years, there have been proposed engines in which the pressure of fuel in an accumulator is controlled to a high pressure value so as to inject the fuel in an atomized state (see, for example, a first patent document (Japanese patent application laid-open No. 2002-188545) and a second patent document (Japanese patent application laid-open No. H8-303325)).

Hereinafter, an example of the construction of a fuel system in such a kind of engine will be described.

A high pressure fuel pump for pressurizing the fuel to be injected to a high pressure is provided with a plunger that reciprocates in a pressure chamber in synchronization with the rotation of a camshaft of the engine, with a lower end of the plunger being arranged in pressure contact with a pump cam mounted on the camshaft. With such an arrangement, as the pump cam rotates in conjunction with the rotation of the camshaft, the plunger is caused to reciprocate in the pressure chamber, whereby the volume of the pressure chamber is changed to expand or contract.

In addition, a high pressure passage (delivery passage) downstream of the pressure chamber is connected with an accumulator through a delivery valve ( check valve) that permits the fuel to pass only in a direction from the pressure chamber toward the accumulator, whereby the accumulator holds the fuel delivered from the pressure chamber and distributes it to fuel injection valves.

Further, a low pressure passage upstream of the pressure chamber is connected with a fuel tank through a normally open flow control valve, a low pressure fuel pump and a low pressure regulator, so that the fuel drawn up from the low pressure fuel pump into the low pressure passage is adjusted to a predetermined feed pressure by the low pressure regulator, and then it is sucked into the pressure chamber through the flow control valve that is opened in a descending period in which the plunger moves downward from top dead center (TDC) up to bottom dead center (BDC) (i.e., a period in which the volume of the pressure chamber expands).

On the other hand, in an ascending period (i.e., a period in which the volume of the pressure chamber contracts) in which the plunger moves upward from the bottom dead center up to the top dead center, when the normally open flow control valve is closed, a maximum amount of fuel pressurized in the pressure chamber is delivered to the accumulator in accordance with the upward movement of the plunger.

In addition, when the flow control valve is not opened at all in the ascending period of the plunger in the high pressure fuel pump, the fuel sucked into the pressure chamber is relieved to the low pressure passage, so it is not delivered to the accumulator.

Moreover, when the flow control valve is closed during the ascending period of the plunger, a part of the fuel sucked into the pressure chamber is relieved into the low pressure passage for a period of time from the bottom dead center of the plunger until the arrival of the flow control valve at its closed position, and subsequently, the fuel left in the pressure chamber is pressurized and delivered into the accumulator for a period of time from the closed position of the flow control valve until the arrival of the plunger at its top dead center.

Thus, by controlling to close the flow control valve at arbitrary timing during the ascending period of the plunger, the amount of fuel delivered to the accumulator can be adjusted to an arbitrary amount between from a maximum amount of delivery to a minimum amount of delivery. Here, note that the normally open flow control valve has a normally deenergized solenoid built therein, so it is driven to close upon energization of the solenoid.

Hereinbelow, detailed reference will be made to the relation between a target closed position (hereinafter simply referred to as a "closed position") TVC of the flow control valve and an amount of delivery fuel Q delivered from the high pressure fuel pump to the accumulator, in the ascending period of the plunger (from the time point of arrival at bottom dead center BDC to the time point of arrival at top dead center TDC) while referring to a timing chart in FIG. 10.

In FIG. 10, the axis of abscissa represents a time base (advance angle side-retard angle side) corresponding to the closed position TVC of the flow control valve, and the axis of ordinate represents, in the order from top to bottom, the active position of the plunger in the high pressure fuel pump (i.e., the ascending period from the bottom dead center BDC to the top dead center TDC being shown herein), energization timing TON of the solenoid (and interruption timing TOFF), the opened/closed state of the flow control valve, the internal pressure of the pressure chamber in the high pressure fuel pump (a pressure value Pa that acts as a valve-closing urging force on the flow control valve), and an amount of delivery fuel Q (a maximum amount of delivery fuel OMAX, an amount of relieved fuel QR, and a target amount of delivery fuel QO).

In FIG. 10, there is shown, as an example, an operation state of the flow control valve at the time when the closed position TVC of the flow control valve is controlled to a substantially midpoint from the time point of arrival of the plunger at the bottom dead center BDC to the time point of arrival thereof at the top dead center TDC.

That is, the energization timing of the solenoid in the flow control valve and the opened/closed state of the flow control valve are controlled in such a manner that the flow control valve is closed at a time point corresponding to the closed position TVC of the flow control valve, and the internal pressure of the pressure chamber is pressurized corresponding to the closed position TVC of the flow control valve.

In the amount of delivery fuel in FIG. 10, a range QR indicated by a broken line arrow represents the amount of fuel relieved to the low pressure passage (an amount of relieved fuel), a range QO indicated by a solid line arrow represents the amount of fuel actually delivered to the accumulator (a target amount of delivery fuel), and the target amount of delivery fuel QO is represented by a difference (QMAX-QR) between the maximum amount of delivery fuel QMAX and the amount of delivery fuel QR.

The maximum amount of delivery fuel QMAX is the amount of fuel sucked to the pressure chamber during the downward movement of the plunger (corresponding to the maximum amount of delivery fuel that can be supplied to a fuel rail).

An unillustrated ECU (electronic control unit) specifies the time point of arrival of the plunger at the bottom dead center BDC based on the rotational position of the engine, and determines, as a time point corresponding to the closed position TVC of the flow control valve, a time point at which a first or former half period Tr has elapsed from the time point of arrival of the plunger at the bottom dead center BDC.

In addition, in order to close the flow control valve at the time point corresponding to the closed position TVC, an energization start time point TON and an energization end time point TOFF for the solenoid of the flow control valve are controlled as energization timings of the solenoid.

At this time, there exists an operation delay time Tp from the start of energization of the solenoid to the completion of closing of the flow control valve, so the energization of the solenoid is started at a time point TON going back by the operation delay time Tp from the time point corresponding to the target closed position TVC.

Also, since the operation delay time Tp is changed mainly depending on the electrical energy supplied to the solenoid, it is stored in a memory in the ECU beforehand as data for individual battery voltages so that an appropriate time is set in accordance with the battery voltage actually detected upon energization of the solenoid. As a result, even if the battery voltage varies, it is possible to control the closed position TVC of the flow control valve with a high degree of precision.

Hereinafter, when the operation delay time Tp has elapsed from the start of energization of the solenoid, the flow control valve completes its valve closing operation (TVC), whereafter the fuel in the pressure chamber is pressurized by an upward movement of the plunger in the high pressure fuel pump, so that the fuel pressure in the pressure chamber itself acts as a valve-closing urging force (≧Pa) sufficient to maintain the flow control valve in its closed state.

The valve-closing urging force due to the fuel pressure in the pressure chamber at this time continues up to a time point just before the time point of arrival of the plunger at the top dead center TDC at which the pressure in the pressure chamber begins to be reduced.

Accordingly, after the fuel pressure in the pressure chamber has risen above the pressure value Pa that acts as the valve-closing urging force enough to close the flow control valve after the closure of the flow control valve, it is possible to maintain the closed state of the flow control valve over a period up to around the time point TDC of arrival of the plunger at the top dead center even without continuing to apply the electromagnetic valve-closing urging force due to the energization of the solenoid.

Thus, in a second patent document, power consumption is intended to be reduced by setting an energization holding time Th, for which the energization of the solenoid is continued after the arrival of the flow control valve at the closed position TVC, to a minimum time that will be required from the time point of arrival of the flow control valve at the closed position TVC to the time the fuel pressure in the pressure chamber itself rises above the pressure value Pa that acts as the valve-closing urging force of the flow control valve.

When the flow control valve is closed at its target closed position TVC, a part of the amount of fuel (=QMAX ), which has been sucked from the low pressure passage to the pressure chamber during the downward or descending movement of the plunger immediately before it (a plunger operation position at an advance angle side from the bottom dead center BDC), is relieved through the opened flow control valve to the low pressure passage as the amount of relieved fuel QR in the ascending period (the first half period Tr in FIG. 10) from the time point of arrival of the plunger at the bottom dead center BDC to the time point of arrival thereof at the closed position TVC.

On the other hand, the flow control valve is closed for a period from the closed position TVC to the time point of arrival of the plunger at the top dead center TDC (a second or latter half period To), so an amount of fuel (=QMAX-QR) left in the pressure chamber at the closed position TVC is pressurized so as to be delivered to the accumulator through the delivery valve as the target amount of the delivery fuel QO.

In addition, for example, when the time point (Tr=0) of the plunger bottom dead center BDC that is the position of the most advance angle side in the plunger ascending period (Tr+To) is decided as the closed position TVC, the flow control valve is closed in the entire plunger ascending period, so the entire amount of fuel (=QMAX) sucked into the pressure chamber is pressurized and delivered to the accumulator as the maximum amount of delivery fuel QMAX.

On the other hand, when the solenoid has not been energized at all in the plunger ascending period, the normally open flow control valve remains opened in the entire plunger ascending period, so the entire amount of fuel (=QMAX) sucked into the pressure chamber is relieved to the low pressure passage, and pressurized fuel is not delivered to the accumulator at all.

Thus, by controlling the closed position TVC to an arbitrary position between from the plunger bottom dead center BDC to the plunger top dead center TDC, it is possible to adjust the amount of fuel to be delivered to the accumulator to an arbitrary amount from the maximum amount of delivery fuel QMAX to the minimum amount of delivery fuel (=0).

The ECU determines a target pressure in accordance with the operating condition of the engine (the number of revolutions per minute of the engine, the amount of depression of an accelerator pedal, etc.), and calculates the target delivery amount QO of the fuel to be delivered to the accumulator through a feedback arithmetic calculation (e.g., PID calculation, etc.) based on a pressure deviation between the value of the fuel pressure in the accumulator. detected by the fuel pressure sensor and the target pressure.

Moreover, the ECU determines a time (or angle) Tr from the position of arrival of the plunger at the bottom dead center BDC based on the relation between the closed position TVC of the flow control valve and the amount of delivery fuel Q (the characteristics of FIG. 10), and controls the actual closed position TVC.

Next, detailed reference will be made to a general control operation when the maximum amount of fuel QMAX is delivered from the high pressure fuel pump while referring to a timing chart (solid lines) in FIG. 11.

In FIG. 11, the axis of abscissa represents a time base, similarly as stated above (FIG. 10), and the axis of ordinate represents, in the order from the top to the bottom, a reference signal REF generated based on the rotational position of the engine, the operation position of the plunger in the high pressure fuel pump, the energization timing of the solenoid in the flow control valve, the opened/closed state of the flow control valve, and the internal pressure in the pressure chamber of the high pressure fuel pump. Here, note that in the operating position of the plunger in FIG. 11, solid lines represent a normal plunger operation, and broken lines represent a plunger operation shifted to a retard angle side.

In FIG. 11, first of all, the ECU generate the reference signal (pulse) REF that indicates a predetermined rotational position in the rotational phase of the engine.

Here, note that the positional relation between the position of the reference signal REF and the position of arrival of the plunger at the bottom dead center BDC that is reached thereafter is stored beforehand in the memory of the ECU as design values, and a time point at which an offset value Td (corresponding to a predetermined time or a predetermined angle) has elapsed from the reference signal REF is specified as the position of arrival of the plunger at the bottom dead center BDC.

Hereinafter, the bottom dead center BDC estimated by the ECU based on the design values is called an "estimated bottom dead center BDC". That is, the ECU recognizes the operation characteristics of the plunger represented by the solid lines in FIG. 11 as the normal operation position of the plunger, and decides, as the target closed position TVC, the same position (i.e., a position of Tr=0) as the estimated bottom dead center BDC when the maximum amount of delivery fuel QMAX (see FIG. 10) is controlled.

The ECU starts to energize the solenoid at the time point TON going back by the operation delay time Tp from the closed position TVC, and terminates the energization of the solenoid at the time point TOFF at which the energization holding time Th has elapsed from the closed position TVC (i.e., at a time point at which the internal pressure of the pressure chamber has reached Pa or higher).

As a result, like the opened/closed state of the flow control valve indicated by a solid line in FIG. 11, the flow control valve is closed at the position of the estimated bottom dead center BDC of the plunger, and the fuel in the pressure chamber is pressurized in the plunger ascending period therefrom to the time point of arrival of the plunger at the top dead center TDC so that the maximum amount of fuel QMAX is delivered to the accumulator.

However, the ECU controls the closed position TVC of the flow control valve in a feedback manner according to a PID calculation based on the pressure deviation between the target pressure determined in accordance with the operating condition of the engine and the fuel pressure in the accumulator, as previously stated above.

Thus, when there occurs a situation in which the fuel pressure in the accumulator is much lower than the target pressure, the amount of feedback correction becomes excessively large so there is a possibility that the closed valve position TVC might pass the estimated bottom dead center BDC toward the advance angle side. In this case, there is a fear that it might become unable to ensure the energization holding time Th that is required to maintain a minimum amount of energization during the ascending period of the plunger, thus making it impossible to control the amount of fuel to be delivered.

Accordingly, in the first patent document (see claim 2), the position of the estimated bottom dead center BDC is decided as an advance angle limiting position LIM (=L0), as shown in FIG. 11, so that the closed position TVC is limited or prevented from being controlled to a position more advanced than the advance angle limiting position LIM (=L0).

As shown in FIG. 11, in a conventional apparatus, in case where the positional relation between the reference signal REF and the estimated bottom dead center BDC that is arrived at thereafter coincides with the design values stored beforehand in the ECU, there will be any problem when the maximum amount of fuel QMAX is delivered from the high pressure fuel pump to the accumulator.

In an actual control apparatus, however, it is considered that the positional relation of the reference signal REF and the estimated bottom dead center BDC that is arrived at thereafter might shift from a normal relation due, for example, to the variations of those parts which are associated with position control such as the assembly positions of the high pressure fuel pump and a cam angle sensor for detecting the rotational position of a cam, the machining accuracy of a pump cam, etc.

However, since in the above-mentioned conventional apparatus, no special consideration is made with respect to the variations of those parts which are associated with the position control of a fuel supply system, there are the following problems.

Hereinafter, specific reference will be made to problems arising when the maximum amount of fuel QMAX is caused to be delivered from the high pressure fuel pump with the occurrence of the variations of the parts associated with position control while referring to FIG. 11, similarly as described above.

Here, note that the characteristics represented by broken lines in FIG. 11 show the operation positions of the plunger when the plunger generates a maximum deviation in the retard angle direction.

The actual bottom dead center BDC1 when the operation position of the plunger generates a maximum deviation to the retard angle side (broken line) shifts by the maximum amount of deviation Trtd to the retard angle side from the estimated bottom dead center BDC when the plunger operates at normal timing (solid line).

In this case, since the ECU does not detect the deviation of the operation position of the plunger even though the plunger operation position has shifted from the normal position, the time point after only the offset value Td has elapsed from the reference signal REF is specified as the estimated bottom dead center BDC assuming that the plunger is in the normal operation position.

Accordingly, in order to deliver the maximum amount of delivery fuel QMAX to the accumulator, the closed position TVC is controlled until the position of Tr=0 (i.e., the same position as the estimated bottom dead center BDC) is made as the advance angle limiting position LIM (=L0).

As a result, the ECU starts to energize the solenoid at the time point TON going back by the operation delay time Tp from the closed position TVC, and terminates the energization of the solenoid at the time point TOFF at which the energization holding time Th has elapsed from the closed position TVC.

However, the actual bottom dead center BDC1 in the actual operation position of the plunger is shifted by the maximum amount of deviation Trtd to the retard angle side from the estimated bottom dead center BDC.

Therefore, in the example of FIG. 11, the energization of the solenoid has been terminated before the plunger arrives at the actual bottom dead center BDC1, so the energization holding time Th for which the solenoid is originally to be energized after the closure of the flow control valve in the ascending period of the plunger can not be ensured.

Accordingly, fuel will pass through the normally open flow control valve which is not closed in the ascending period of the plunger (the opened/closed state of the flow control valve indicated by the broken line in FIG. 11), as a consequence of which the fuel sucked into the pressure chamber is relieved to the low pressure passage through the flow control valve that remains in the open state, and hence the fuel is not delivered to the accumulator.

In the conventional high pressure fuel pump control apparatus for an engine, in cases where the plunger generates the maximum amount of deviation Trtd in the retard angle direction resulting from variations associated with the position control of the flow control valve, when the maximum amount of delivery fuel QMAX is to be delivered to the accumulator, the energization to the solenoid is terminated based on the estimated bottom dead center BDC more advanced than the actual bottom dead center BDC1, so there might occur a situation where delivery control becomes impossible.

Thus, there arises the following problems. That is, when the maximum amount of delivery fuel QMAX is controlled to be delivered, there occurs a situation in which fuel delivery control becomes unable to be done due to variations associated with the position control of the flow control valve, so a required amount of fuel can not be delivered to the accumulator, and hence the fuel pressure in the accumulator can not be maintained at the target pressure, making it impossible to obtain desired combustion performance and inducing deterioration in drivability and the exhaust gas.

SUMMARY OF THE INVENTION

Accordingly, the present invention is intended to obviate the problems as referred to above, and has for its object to obtain a high pressure fuel pump control apparatus for an engine which is capable of detecting the occurrence of a situation where when the amount of fuel to be delivered to an accumulator is to be controlled to a maximum amount of delivery fuel, fuel delivery control becomes unable to be done due to variations associated with the position control of a fuel control valve, and restoring a fuel delivery control function in a quick manner.

Bearing the above object in mind, according to the present invention, there is provided a high pressure fuel pump control apparatus for an engine which includes: a variety of kinds of sensors that detect an operating condition of an engine; a low pressure fuel pump that draws up fuel in a fuel tank and delivers it to a low pressure passage; a high pressure fuel pump that sucks the fuel delivered from the low pressure fuel pump into a pressure chamber and delivers it therefrom; a normally open flow control valve that is arranged in a fuel passage connecting the pressure chamber and either one of the fuel tank and the low pressure passage; a delivery valve that is arranged in a high pressure passage connecting between the pressure chamber and an accumulator; fuel injection valves that supply the fuel in the accumulator to respective combustion chambers of the engine; a fuel pressure sensor that detects the pressure of fuel in the accumulator and outputs the value of the fuel pressure thus detected; a flow control valve control section that controls an amount of delivery fuel of the high pressure fuel pump by setting a closed position of the flow control valve; and an advance angle setting limiting section that limits the closed position from being set to a location advanced from a predetermined advance angle limiting position to an advance angle side. The flow control valve control section decides a target pressure in accordance with the operating condition of the engine, and sets the closed position in such a manner that the detected fuel pressure value coincides with the target pressure. When the closed position is being controlled to be limited to the advance angle limiting position, and when the detected fuel pressure value does not show a tendency to coincide with the target pressure, the advance angle setting limiting section changes the advance angle limiting position from the last set value to a value more retarded than the last set value.

According to the present invention, by detecting the occurrence of a situation where when the amount of fuel to be delivered is to be controlled to the maximum amount of delivery fuel,.fuel delivery control becomes impossible due to variations associated with the position control of the fuel control valve, and quickly restoring a fuel delivery control function, it is possible to provide a high pressure fuel pump control apparatus for an engine that is able to reduce or avoid inducing deterioration in drivability and an exhaust gas, which would otherwise be caused by inability to maintain the fuel pressure in the accumulator at a target pressure and hence to obtain desired combustion performance.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described in detail while referring to the accompanying drawings.

Embodiment 1

Hereinafter, reference will first be made to a high pressure fuel pump control apparatus for an engine according to a first embodiment of the present invention while referring to the accompanying drawings.

Figure 1:
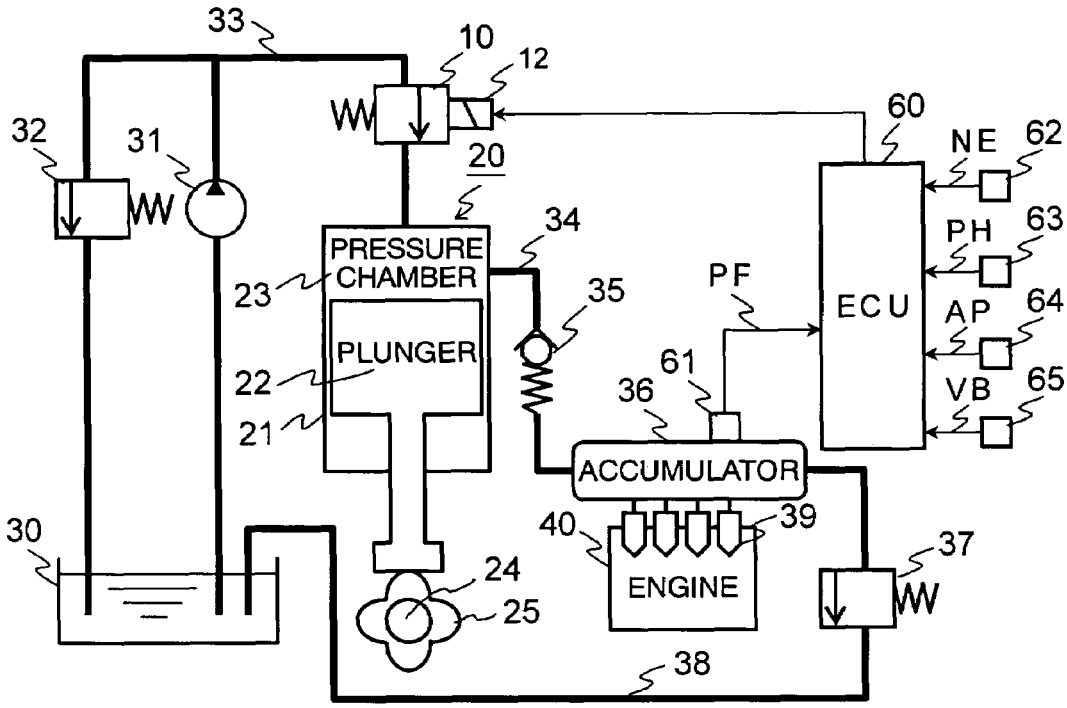
FIG. 1 is a block diagram schematically showing a high pressure fuel pump control apparatus for an engine according to a first embodiment of the present invention.

FIG. 1 is a block diagram that schematically shows a high pressure fuel pump control apparatus for an engine according to a first embodiment of the present invention.

In FIG. 1, the high pressure fuel pump control apparatus for an engine include, as a fuel supply system, a normally open flow control valve 10 with a solenoid 12, a high pressure fuel pump 20 having a cylinder 21, a plunger 22 and a pressure chamber 23, a camshaft 24 with a pump cam 25, a fuel tank 30 having fuel filled therein, a low pressure passage 33 connected to the fuel tank 30 through a low pressure fuel pump 31 and a low pressure regulator 32, a high pressure passage (delivery passage) 34 connected to the pressure chamber 23 of the high pressure fuel pump 20, an accumulator 36 connected to the high pressure passage 34 through a delivery valve (check valve) 35, a relief passage 38 connecting between the accumulator 36 and the fuel tank 30 through a relief valve 37, and a plurality of fuel injection valves 39 for injecting fuel accumulated in the accumulator 36 to an engine 40.

In addition, the high pressure fuel pump control apparatus for an engine further includes, as a control system, an ECU 60 that controls excitation (valve closing) drive timing of the solenoid 12 of the flow control valve 10 in the form of an electromagnetic valve.

The ECU 60 includes a flow control valve control section and an advance angle setting limiting section, and detection signals from a variety of kinds of sensors such as a fuel pressure sensor 61, a crank angle sensor 62, a cam angle sensor 63, an accelerator position sensor 64, and a battery voltage detection part 65 are input to the ECU 60 as the operating condition information of the engine 40.

The low pressure fuel pump 31 serves to draw up fuel in the fuel tank 30 and deliver it to the low pressure passage 33, whereas the high pressure fuel pump 20 serves to suck the fuel delivered from the low pressure fuel pump 31 into the pressure chamber 23 and deliver it therefrom.

The low pressure passage 33 is connected with an upstream side of the pressure chamber 23 defined in the high pressure fuel pump 20 through the flow control valve 10. That is, the flow control valve 10 is arranged in a fuel passage that connects the low pressure passage 33 and the pressure chamber 23 with each other.

The delivery valve 35 is arranged in the high pressure passage 34 that connects the pressure chamber 23 and the accumulator 36 with each other.

The fuel injection valves 39 serve to supply, through direct injection, high pressure fuel in the accumulator 36 to individual combustion chambers of the respective cylinders of the engine 40.

The fuel pressure sensor 61 detects a fuel pressure PF in the accumulator 36, and inputs it to the ECU 60 as a detected fuel pressure value.

The flow control valve control section in the ECU 60 decides a target pressure PO in accordance with the operating condition of the engine 40, and controls the amount of delivery fuel of the high pressure fuel pump 20 by setting the closed position of the flow control valve 10 in such a manner that the detected fuel pressure value PF (hereinafter referred to simply a "fuel pressure") coincides with the target pressure PO.

The advance angle setting limiting section in the ECU 60 serves to limit or prevent the closed position set by the flow control valve control section from being set to a location advanced from a predetermined advance angle limiting position to the advance angle side.

In addition, when the closed position of the flow control valve 10 is being controlled to be limited to the advance angle limiting position, and when the fuel pressure PF does not show a tendency to coincide with the target pressure PO, the advance angle setting limiting section changes the advance angle limiting position from the last set value to a value more retarded therefrom.

Also, when the closed position of the flow control valve 10 is being controlled to be limited to the advance angle limiting position which has been changed to a value at the retard angle side, and when the fuel pressure PF shows a tendency to coincide with the target pressure PO, the flow control valve control section in the ECU 60 stores, as a position deviation learning value, a positional deviation between the advance angle limiting positions before and after the closed position of the flow control valve 10 has been changed to the value at the retard angle side, and controls to correct, after storage of the position deviation learning value, the closed position of the flow control valve 10 by adding the position deviation learning value thereto.

Further, as will be described later, the ECU 60 further includes an abnormality diagnosis section that determines the presence or absence of abnormality of the fuel supply system including the low pressure fuel pump 31, the high pressure fuel pump 20 and the flow control valve 10.

When the advance angle limiting position changed to the retard angle side by the advance angle setting limiting section reaches a value retarded from a predetermined abnormality determination value, the abnormality diagnosis section in the ECU 60 determines that the fuel supply system is in an abnormality occurrence or abnormal state.

The fuel delivered from the low pressure fuel pump 31 to the low pressure passage 33 side of the fuel supply system is adjusted to a predetermined low pressure value by the low pressure regulator 32, so that it is introduced into the pressure chamber 23 through the flow control valve 10 when the plunger 22 moves downward in the cylinder 21.

The plunger 22 in the high pressure fuel pump 20 reciprocates in the cylinder 21 in synchronization with the rotation of the engine 40, whereby the high pressure fuel pump 20 supplies fuel from the low pressure passage 33 into the pressure chamber 23 through the flow control valve 10 in the descending period of the plunger 22, and pressurizes the fuel in the pressure chamber 23 to a high pressure thereby to supply it to the accumulator 36 through the delivery valve 35 during the closure of the flow control valve 10 in the ascending period of the plunger 22.

The pressure chamber 23 is defined by an inner peripheral wall surface of the cylinder 21 and an upper end face of the plunger 22.

A lower end of the plunger 22 is in pressure contact with the pump cam 25 mounted on the camshaft 24, so that as the pump cam 25 is driven to rotate in conjunction with the rotation of the camshaft 24, the plunger 22 is caused to reciprocate in the cylinder 21, whereby the volume of the pressure chamber 23 is changed to expand and contract.

The high pressure passage 34 connected to a downstream side of the pressure chamber 23 is connected with the accumulator 36 through the delivery valve 35 in the form of a check valve that permits fuel to pass only in a direction from the pressure chamber 23 toward the accumulator 36.

The accumulator 36 accumulates and holds the high pressure fuel delivered from the pressure chamber 23, and it is connected in common to the individual fuel injection valves 39 of the engine 40 for distributing the high pressure fuel to the fuel injection valves 39, respectively.

The relief valve 37 connected to the accumulator 36 is in the form of a normally closed valve that is opened at a fuel pressure higher than a predetermined fuel pressure (valve-opening pressure set value), and it is opened when the fuel pressure in the accumulator 36 is going to rise to the set value of the valve-opening pressure of the relief valve 37 or above. As a result, the fuel in the actuator 36, being about to rise to the valve-opening pressure set value or above, is returned to the fuel tank 30 through the relief passage 38, so that the fuel pressure in the accumulator 36 does not become excessively large.

The flow control valve 10, being arranged in the low pressure passage 33 connecting between the low pressure fuel pump 31 and the pressure chamber 23, is controlled in its valve closing (excitation) drive timing by means of the ECU 60, so that the target amount of delivery fuel QO from the high pressure fuel pump 20 to the accumulator 36 can be adjusted in an appropriate manner.

In the high pressure fuel pump 20, during the time when the flow control valve 10 is controlled to be opened (deenergized) upon the upward movement of the plunger 22 in the cylinder 21 (the volume of the pressure chamber 23 be reduced), the fuel sucked into the pressure chamber 23 is returned from the pressure chamber 23 to the low pressure passage 33 through the flow control valve 10, so the high pressure fuel is not supplied to the accumulator 36.

On the other hand, after the flow control valve 10 is controlled to be closed (energized) at predetermined timing in the upward movement of the plunger 22 in the cylinder 21, the fuel pressurized in the pressure chamber 23 is delivered to the delivery passage 34 so as to be supplied to the accumulator 36 through the delivery valve 35.

The ECU 60 takes in, as various kinds of operating condition information, the fuel pressure PF in the accumulator 36 detected by the fuel pressure sensor 61, the number of revolutions per minute NE of the crankshaft of the engine 40 detected by the crank angle sensor 62, the rotational position (the rotational phase) PH of the camshaft 24 of the engine 40 detected by the cam angle sensor 63, the amount of depression AP of an accelerator pedal (not shown) detected by the accelerator position sensor 64, and a battery voltage VB detected by the battery voltage detection part 65.

Further, the ECU 60 decides the target pressure PO based on the detection information (the number of engine revolutions per minute NE and the amount of accelerator pedal depression AP) from the crank angle sensor 62 and the accelerator position sensor 64, and controls the amount of delivery fuel Q by controlling the drive timing of the solenoid 12 of the flow control valve 10 in a feedback manner such that the fuel pressure PF in the accumulator 36 coincides with the target pressure PO.

Next, reference will be made to the specific internal construction of the flow control valve 10 in FIG. 1 while referring to cross sectional side views of FIGS. 2 and 3.

Figure 2:
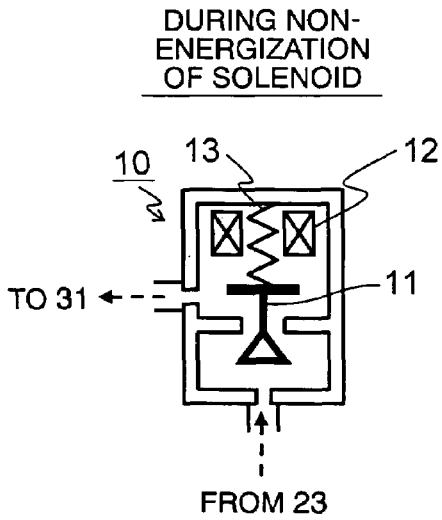
FIG. 2 is a cross sectional side view showing the internal configuration of a flow control valve in FIG. 1 in its open state.
Figure 3:
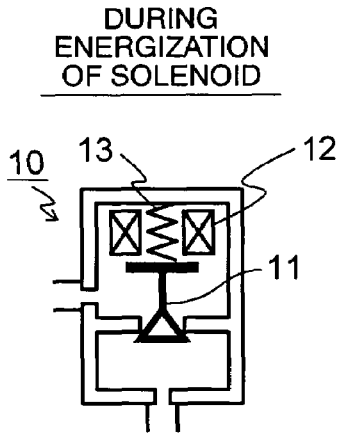
FIG. 3 is a cross sectional side view showing the internal configuration of the flow control valve in FIG. 1 at its closed state.

Here, note that FIG. 2 illustrates one state of the flow control valve 10 when the solenoid 12 is in its non-energized (deenergized) state, and FIG. 3 illustrates another state of the flow control valve 10 when the solenoid 12 is energized (driven to be excited).

In FIGS. 2 and 3, the flow control valve 10 includes a plunger 11 that serves to open and close the state of communication between the low pressure fuel pump 31 and the pressure chamber 23, the solenoid 12 that causes, upon energization (excitation driving) thereof, the plunger 11 to move upward in a closing direction, and a spring 13 that urges, upon non-energization (deenergization) of the solenoid 12, the plunger 11 in an opening direction.

As a result, the flow control valve 10 opens and closes the low pressure passage 33 between the low pressure fuel pump 31 and the pressure chamber 23 in accordance with the non-energized state (see FIG. 2) or the energized state (see FIG. 3) of the solenoid 14.

That is, when the solenoid 12 is in the non-energized state, as shown in FIG. 2, the plunger 11 is depressed downwardly by the urging force of the spring 13 to place the low pressure passage 33 at the side of the low pressure fuel pump 33 and the pressure chamber 23 in communication with each other, so the flow control valve 10 is put into an open state.

On the other hand, when the solenoid 12. is energized by the ECU 60, as shown in FIG. 3, an electromagnetic force generated by the solenoid 12 overcomes the urging force of the spring 13 thereby to electromagnetically attract the plunger 11 in the upward direction, so the communication between the low pressure passage 33 at the side of the low pressure fuel pump 31 and the pressure chamber 23 is interrupted to put the flow control valve 10 into its closed state.

Next, reference will be made to a specific configuration to achieve the control function of the ECU 60 according to the present invention while referring to a functional block diagram in FIG. 4.

Figure 4:
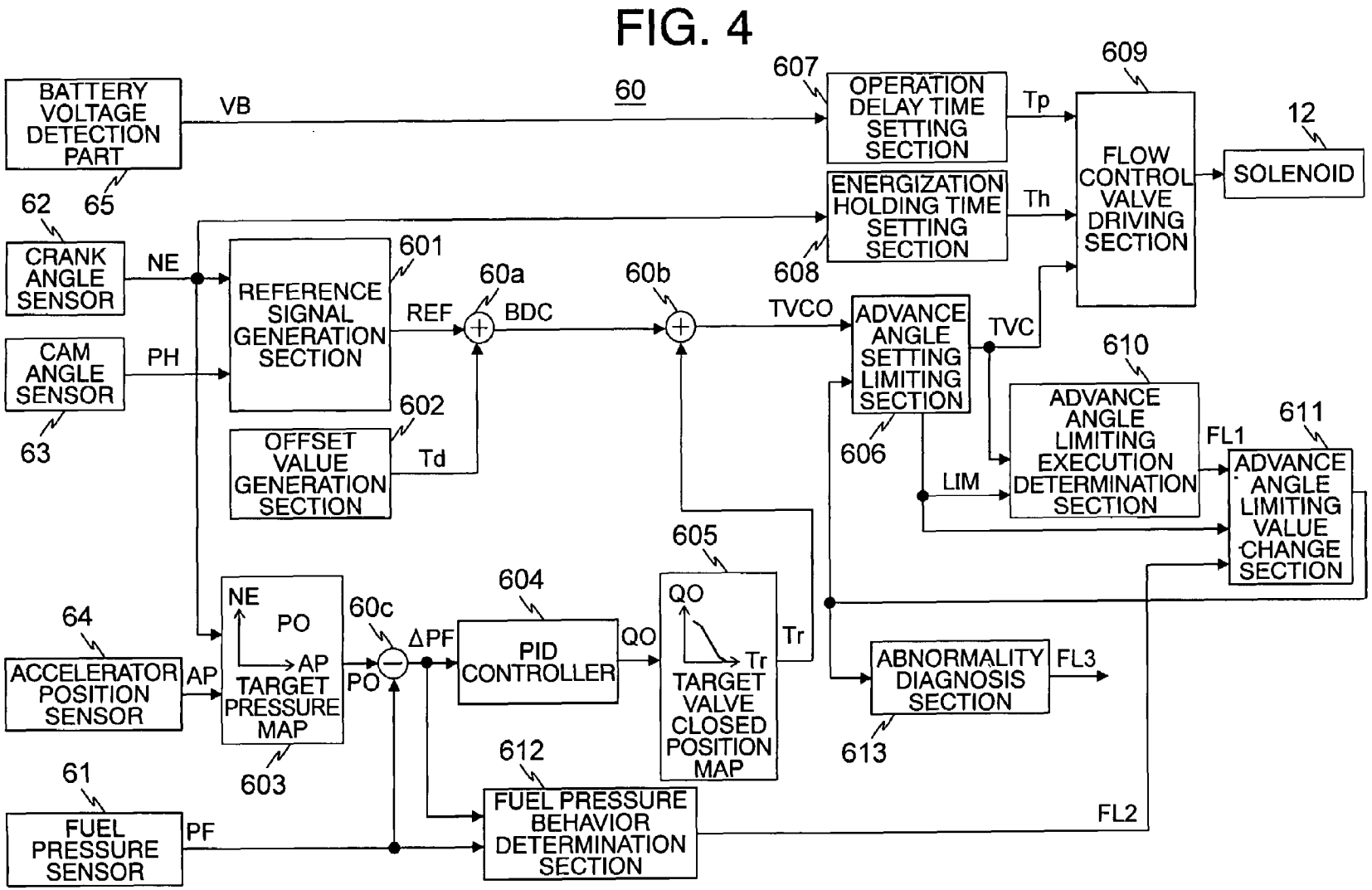
FIG. 4 is a functional block diagram specifically showing an ECU including a flow control valve control section according to the first embodiment of the present invention.

FIG. 4 shows the functional configuration of the ECU 60, in which the above-mentioned (FIG. 1) related components 12 and 61 through 65 are identified by the above-mentioned same symbols, and a detailed explanation is omitted.

The ECU 60 functions as a control section for the solenoid 12 of the flow control valve 10.

In FIG. 4, the ECU 60 includes a reference signal generation section 601 that generates a reference signal REF, an offset value generation section 602 that generates an offset value Td, a target pressure map 603 that generates the target pressure PO, a PID controller 604 that generates the target amount of delivery fuel QO, a valve closed position map 605 that generates a first half period Tr until the valve-closing time of the high pressure fuel pump 20) (in the plunger ascending period), an advance angle setting limiting section 606 that generates the closed position TVC and the advance angle limiting position LIM of the flow control valve 10, an operation delay time setting section 607 that sets the operation delay time Tp, an energization holding time setting section 608 that sets the energization holding time Th, a flow control valve driving section 609 that excitation drives the solenoid 12 of the flow control valve 10, an advance angle limiting execution determination section 610 that sets an advance angle limiting execution flag FL1 when it is determined that control according to advance angle limitation, an advance angle limiting value change section 611 that changes an advance angle limiting value (advance angle limiting position LIM), a fuel pressure behavior determination section 612 that determines the behavior of the fuel pressure and generates a pressure abnormality determination flag FL2, an abnormality diagnosis section 613 that diagnoses the presence or absence of abnormality from the advance angle limiting position LIM changed, and calculation sections such as adders 60*a*, 60*b*, a subtracter 60*c*, etc.

Electrically connected to the ECU 60 are the fuel pressure sensor 61 that detects the fuel pressure PF in the accumulator 36, the crank angle sensor 62 that detects the number of revolutions per minute NE of the engine 40, the cam angle sensor 63 that detects the rotational phase of the camshaft 24 (see FIG. 1) of the engine 40, the accelerator position sensor 64 that detects the amount of accelerator pedal depression AP, and the battery voltage detection part 65 that detects the battery voltage VB. The ECU 60 drives and controls the solenoid 12 for closing the flow control valve 10 based on the detected information of the various kinds of sensors including the sensor part. In addition, though not illustrated in FIG. 4, the ECU 60 functions as an engine control section to drive and control various kinds of actuators such as the fuel injection valves 39 (see FIG. 1), etc., in accordance with the operating condition of the engine 40.

The reference signal generation section 601 generates the reference signal REF based on the number of revolutions per minute NE of the engine 40 and the rotational phase PH of the cam angle 24.

The adder 60a specifies the time point of arrival at the estimated bottom dead center BDC by adding the offset value Td to the reference signal REF.

Here, note that the offset value Td is data that defines a time difference (or angular difference) between the time point of arrival at the reference signal REF and the time point of arrival at the estimated bottom dead center BDC, and it is stored beforehand in a memory in the ECU 60 as an initial design value.

The target pressure map 603 decides the target pressure PO through map search based on the number of engine revolutions per minute NE and the amount of accelerator pedal depression AP.

The subtracter 60*c* calculates a pressure deviation ΔPF (=PO−PF) between the target pressure PO and the fuel pressure PF in the accumulator 36.

The pressure deviation ΔPF is input to the PID controller 604 in the form of a PID calculation section, where it is converted into the target amount of delivery fuel QO.

The valve closed position map 605 decides, based on the target amount of delivery fuel QO, the first half period (or angle) Tr until the closed position TVC when the plunger bottom dead center BDC is made a reference.

Figure 10:
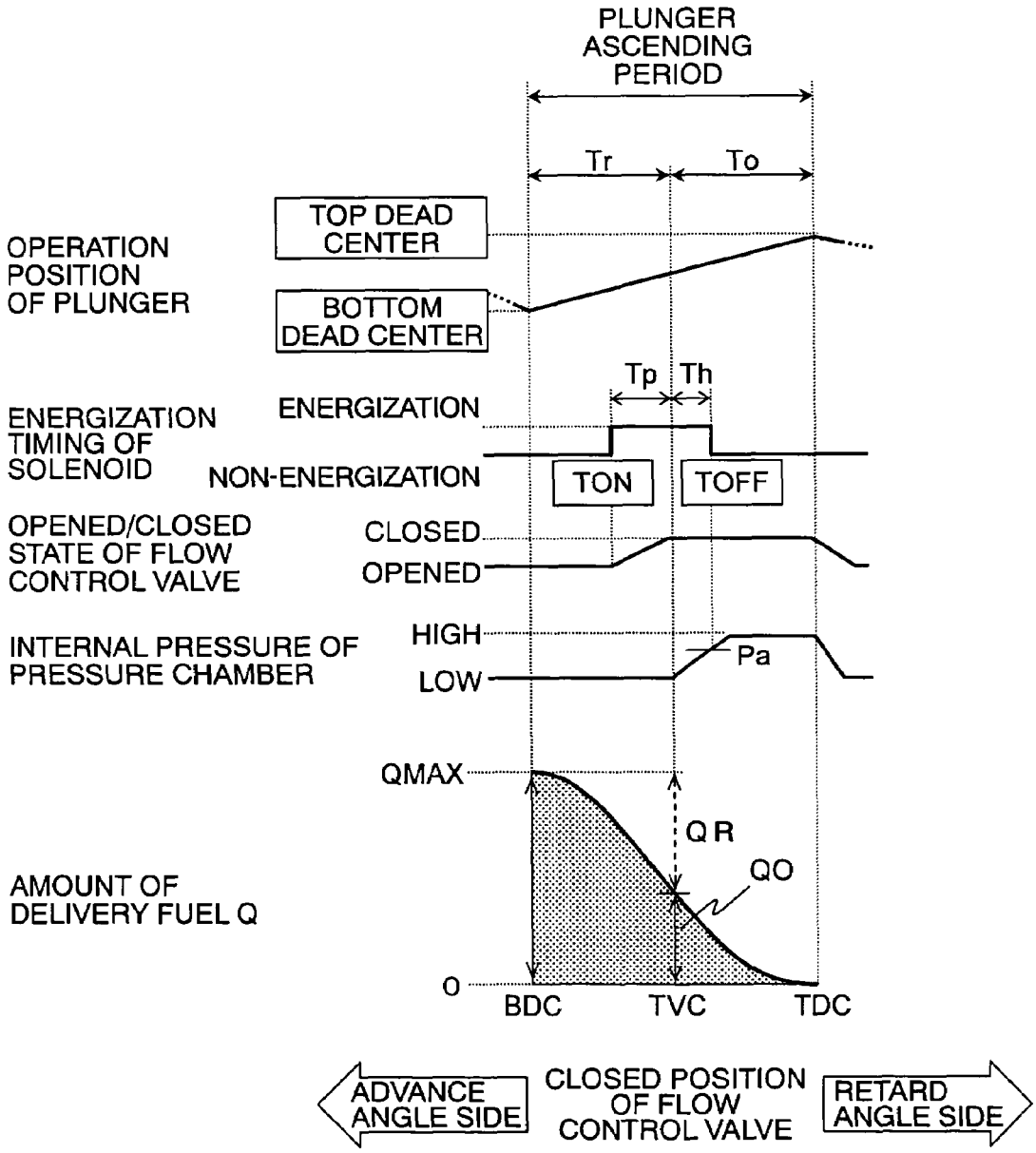
FIG. 10 is a timing chart illustrating the relation (characteristics) between the closed position of a general flow control valve and the amount of delivery fuel.

The valve closed position map 605 is stored beforehand in the memory in the ECU 60 as map data that represents the relation of the amount of delivery fuel Q to the closed position TVC of the flow control valve 10 (e.g., see FIG. 10).

The adder 60*b* calculates a basic closed position TVCO of the flow control valve 10 by adding the first half period Tr corresponding to the closed position TVC to the time point of arrival at the estimated bottom dead center BDC.

The advance angle setting limiting section 606 serves to limit or prevent the basic closed position TVCO of the flow control valve 10 from being set to a location advanced from the predetermined advance angle limiting position LIM to the advance angle side.

For example, when taking as an example a case where the advance angle limiting position LIM is initially set to a position which is the same as the time point of arrival at the estimated bottom dead center BDC, even if the target amount of delivery fuel QO calculated based on the pressure deviation ΔPF by the PID controller 604 becomes excessive (i.e., even if the first half period Tr is calculated to a point advanced from the time point of arrival at the estimated bottom dead center BDC), the closed position TVC is limited by the advance angle limiting position LIM (default or initially set value), so it is finally limited to a range until the time point of arrival of the estimated bottom dead center BDC (=the advance angle limiting position LIM).

Thus, the advance angle setting limiting section 606 finally inputs the closed position TVC (the closed position limited by the advance angle limiting position LIM) to the flow control valve driving section 609.

In addition, the advance angle setting limiting section 606 inputs the closed position TVC and the current advance angle limiting position LIM to the advance angle limiting execution determination section 610 and the advance angle limiting value change section 611.

The operation delay time setting section 607 sets the operation delay time Tp of the flow control valve 10 based the battery voltage VB, and inputs it to the flow control valve driving section 609.

The energization holding time setting section 608 sets the energization holding time Th of the flow control valve 10 based on the number of engine revolutions per minute NE and inputs it to the flow control valve driving section 609.

The flow control valve driving section 609 generates a control signal to the solenoid 12 of the flow control valve 10 based on the closed position TVC input from the advance angle setting limiting section 606, the operation delay time Tp input from the operation delay time setting section 607, and the energization holding time Th input from the energization holding time setting section 608.

That is, the flow control valve driving section 609 controls the flow control valve 10 in such a manner that the energization of the solenoid 12 is started at the time point TON going back by the operation delay time Tp from the closed position TVC, and terminated at the time point TOFF at which the energization holding time Th has elapsed from the closed position TVC.

The advance angle limiting execution determination section 610 determines, based on the closed position TVC and the advance angle limiting position LIM input from the advance angle setting limiting section 606, whether the closed position TVC is being controlled to be limited to the advance angle limiting position LIM, and inputs an advance angle limiting execution flag FL1 corresponding to the result of the determination to the advance angle limiting value change section 611.

The advance angle limiting execution flag FL1 is set to "1" when it is determined that the closed position TVC is under the advance angle limiting control, and is cleared to zero when it is determined that the closed position TVC is not under the advance angle limiting control.

The fuel pressure behavior determination section 612 determines, based on the fuel pressure PF in the accumulator 36 detected by the fuel pressure sensor 61 and the pressure deviation ΔPF (=PO−PF), whether the fuel pressure PF in the accumulator 36 shows a tendency to coincide with the target pressure PO, and inputs a pressure abnormality determination flag FL2 corresponding to the result of the determination to the advance angle limiting value change section 611.

For example, when the average value of the fuel pressure PF shows a decreasing tendency to only decrease below the predetermined value, or when the state that the sign of the pressure deviation ΔPF indicates negative (PO<PF) continues over a predetermined time or more, the fuel pressure behavior determination section 612 assumes that the fuel pressure PF does not show a tendency to coincide with the target pressure PO, and sets the pressure abnormality determination flag FL2 to "1", whereas when it is determined that the fuel pressure PF shows a tendency to coincide with the target pressure PO, the fuel pressure behavior determination section 612 clears the pressure abnormality determination flag FL2 to zero.

When both the advance angle limiting execution flag FL1 and the pressure abnormality determination flag FL2 are set to "1" by making reference to the advance angle limiting execution flag FL1 from the advance angle limiting execution determination section 610 and the pressure abnormality determination flag FL2 from the fuel pressure behavior determination section 612, the advance angle limiting value change section 611 changes the advance angle limiting position LIM to a value at the retard angle side from its current value, and inputs it to the advance angle setting limiting section 606 and the abnormality diagnosis section 613.

As a result, in the advance angle setting limiting section 606, the advance angle limiting position LIM set up to the last time is changed to the new advance angle limiting position LIM (a value at the retard angle side from the last value) input from the advance angle limiting value change section 611.

Also, when the advance angle limiting position LIM input from the advance angle limiting value change section 611 is to be changed to a value at the retard angle side that exceeds an abnormality determination value LX (a maximum permissible retard angle value set in consideration of the "degree of variation" that can happen in normal time), the abnormality diagnosis section 613 determines that abnormality occurs in the fuel supply system, so it sets an abnormality diagnosis flag FL3 to "1" and outputs it to external equipment or the like.

Now, reference will be made to the control operation of the ECU 60 according to the first embodiment of the present invention as illustrated in FIG. 4 while referring to a flow chart in FIG. 5.

Figure 5:
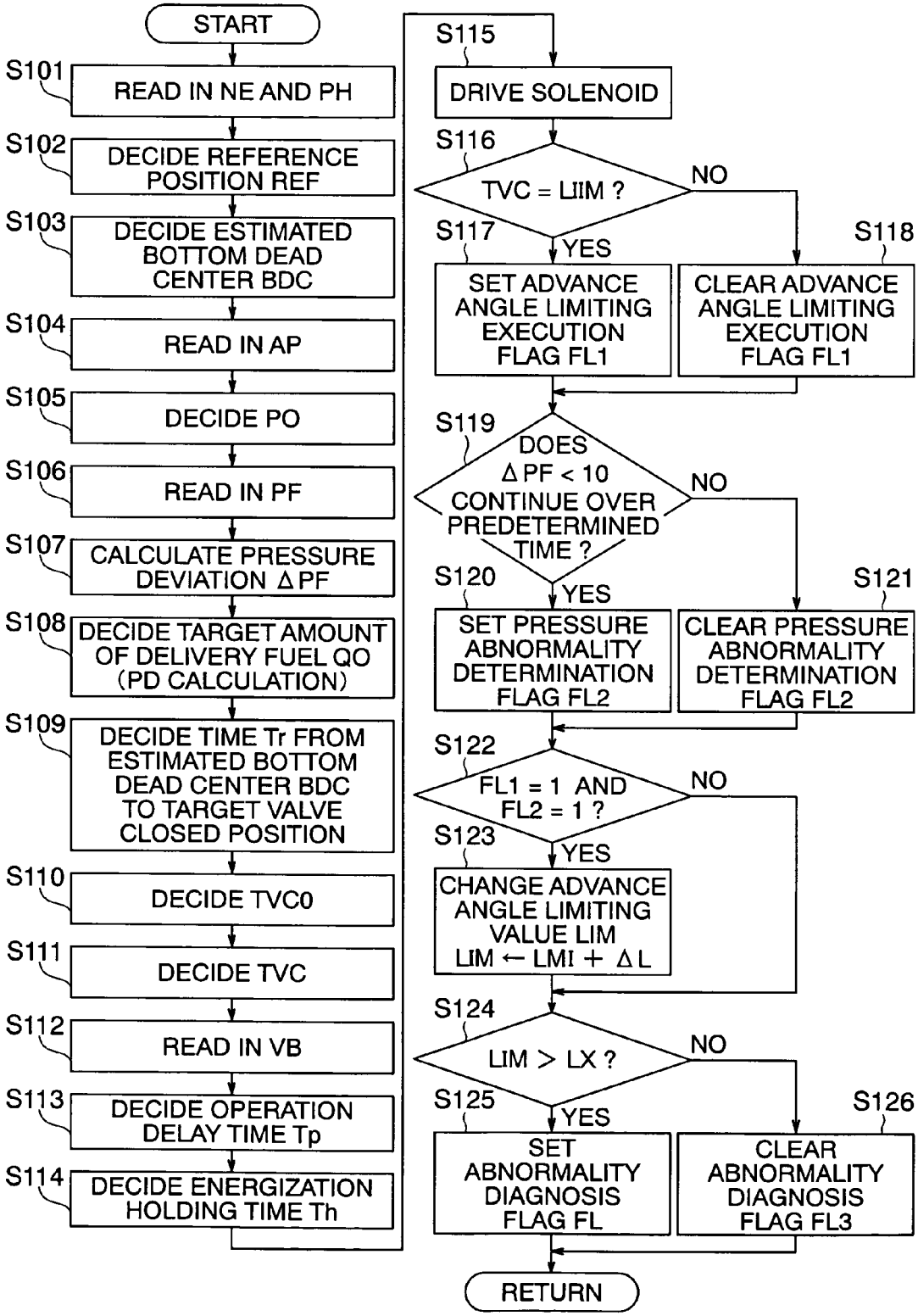
FIG. 5 is a flow chart illustrating the control operation of the first embodiment of the present invention.

In FIG. 5, first of all, the ECU 60 reads in the number of engine revolutions per minute NE and the rotational phase PH (step S101), and the reference signal generation section 601 decides a reference position REF based on the number of engine revolutions per minute NE and the rotational phase PH (step S102), and the adder 60*a* adds the offset value Td to the reference position REF and decides an estimated bottom dead center position BDC (=REF+Td) (step S103).

Subsequently, the amount of accelerator pedal depression AP by the driver of a vehicle is read in for example (step S104), and the target pressure map 603 decides the target pressure PO based on the number of engine revolutions per minute NE and the amount of accelerator pedal depression AP (step S105).

Also, the fuel pressure PF in the accumulator 36 is read in (step S106), and the subtracter 60*c* calculates the pressure deviation ΔPF (=PO−PF) between the target pressure PO and the fuel pressure PF in the accumulator 36.

Subsequently, the PID controller 604 executes a PID calculation based on the pressure deviation ΔPF, and decides the target amount of delivery fuel QO (step S108).

In addition, the valve closed position map 605 decides the first half period Tr corresponding to a time (or angle) from the estimated bottom dead center BDC to the closed position of the flow control valve 10 based on the target amount of delivery fuel QO (step S109).

Then, the adder 60*b* decides a basic closed position TVCO (=BDC+Tr) by adding the first half period Tr to the arrival position of the estimated bottom dead center BDC (step S110).

Moreover, the advance angle setting limiting section 606 decides a final closed position TVC (=MAX {TVC0, LIM}) while limiting the basic closed position TVCO from being set to a location at the advance angle side from the advance angle limiting position LIM (step S111).

Subsequently, the operation delay time setting section 607 reads in the battery voltage VB (step S112), and decides the operation delay time Tp corresponding to the battery voltage VB (step S113).

Also, the energization holding time setting section 608 decides the energization holding time Th corresponding to the number of engine revolutions per minute NE (step S114).

Further, the flow control valve driving section 609 controls the driving of the solenoid 12 in such a manner that it starts to energize the solenoid 12 based on the closed position TVC, the operation delay time Tp, and the energization holding time Th at a time going back the operation delay time Tp from the closed position TVC, and terminates the energization of the solenoid 12 at a time after the energization holding time Th has elapsed from the closed position TVC (step S115).

Then, the advance angle limiting execution determination section 610 determines whether the closed position TVC is in a control state in which it is limited to the advance angle limiting position LIM (i.e., whether or not TVC=LIM) (step S116).

When it is determined as TVC=LIM in step S116 (that is, YES), the advance angle limiting execution flag FL1 is set to "1" (step S117).

On the other hand, when it is determined as TVC≠LIM in step S116 (that is, NO), the advance angle limiting execution flag FL1 is cleared to zero (step S118).

Subsequently, the fuel pressure behavior determination section 612 determines whether the state in which the sign of the pressure deviation ΔPF is negative (ΔPF<0) continues over a predetermined time or more (step S119).

When it is determined in step S119 that the state of ΔPF<0 continues for the predetermined time or more (that is, YES), it is assumed that the fuel pressure PF does not show a tendency to coincide with the target pressure PO, so the pressure abnormality determination flag FL2 is set to "1" (step S120).

On the other hand, when it is determined in step S119 that the state of ΔPF<0 does not continue for the predetermined time or more(that is, NO), it is assumed that the fuel pressure PF shows a tendency to coincide with the target pressure PO, so the pressure abnormality determination flag FL2 is cleared to zero (step S121).

Subsequently, the advance angle limiting value change section 611 determines whether the advance angle limiting execution flag FL1 and the pressure abnormality determination flag FL2 are both set to "1" (step S122).

When it is determined as FL1=1 and FL2=1 in step S122 (that is, YES), it is assumed that the closed position of the flow control valve 10 is being controlled to be limited to the advance angle limiting position, and that the fuel pressure PF does not show a tendency to coincide with the target pressure PO, the advance angle limiting position LIM is changed to a value (=LIM+ΔL) that is obtained by adding a predetermined amount ΔL to the advance angle limiting position LIM so as to be changed to a position at the retard angle side (step S123).

Here, note that the predetermined amount ΔL is a reference amount of correction when the advance angle limiting position LIM is changed to the retard angle side.

On the other hand, when it is determined as FL1=0 or FL2=0 in step S122 (that is, NO), it is assumed that the closed position TVC is not under control in which it is limited to the advance angle limiting position LIM, or that the closed position TVC is in a state in which the fuel pressure PF shows a tendency to coincide with the target pressure PO, so the processing of changing the advance angle limiting position LIM (step S123) is skipped.

Finally, the abnormality diagnosis section 613 determines whether the advance angle limiting position LIM at the current point in time is changed to a value at the retard angle side that exceeds the abnormality determination value LX (step S124).

However, note that, as stated above, the abnormality determination value LX is set to a position that is displaced from an initial value L0 of the advance angle limiting value to the retard angle side by a maximum width of variation Lrtd that can occur in normal time. For example, the abnormality determination value LX is set to an advance angle limiting position L2 (to be described later) at the maximum retard angle side.

When it is determined as LIM>LX in step S124 (that is, YES), it is assumed that the advance angle limiting position LIM at the current point in time has been set to a position at the retard angle side that exceeds a permissible value, so the abnormality diagnosis flag FL3 is set to "1" (step S125), and the processing routine of FIG. 5 is exited.

On the other hand, when it is determined as LIM≦Lrtd in step S124 (that is, NO), it is assumed that the advance angle limiting position LIM at the current point in time has not exceeded the permissible value, so the abnormality diagnosis flag FL3 is cleared to zero (step S126), and the processing routine of FIG. 5 is exited.

Next, reference will be made to the operation of the first embodiment of the present invention as illustrated in FIGS. 1 through 4 while referring to a timing chart in FIG. 6 together with the above-mentioned FIG. 11.

Figure 6:
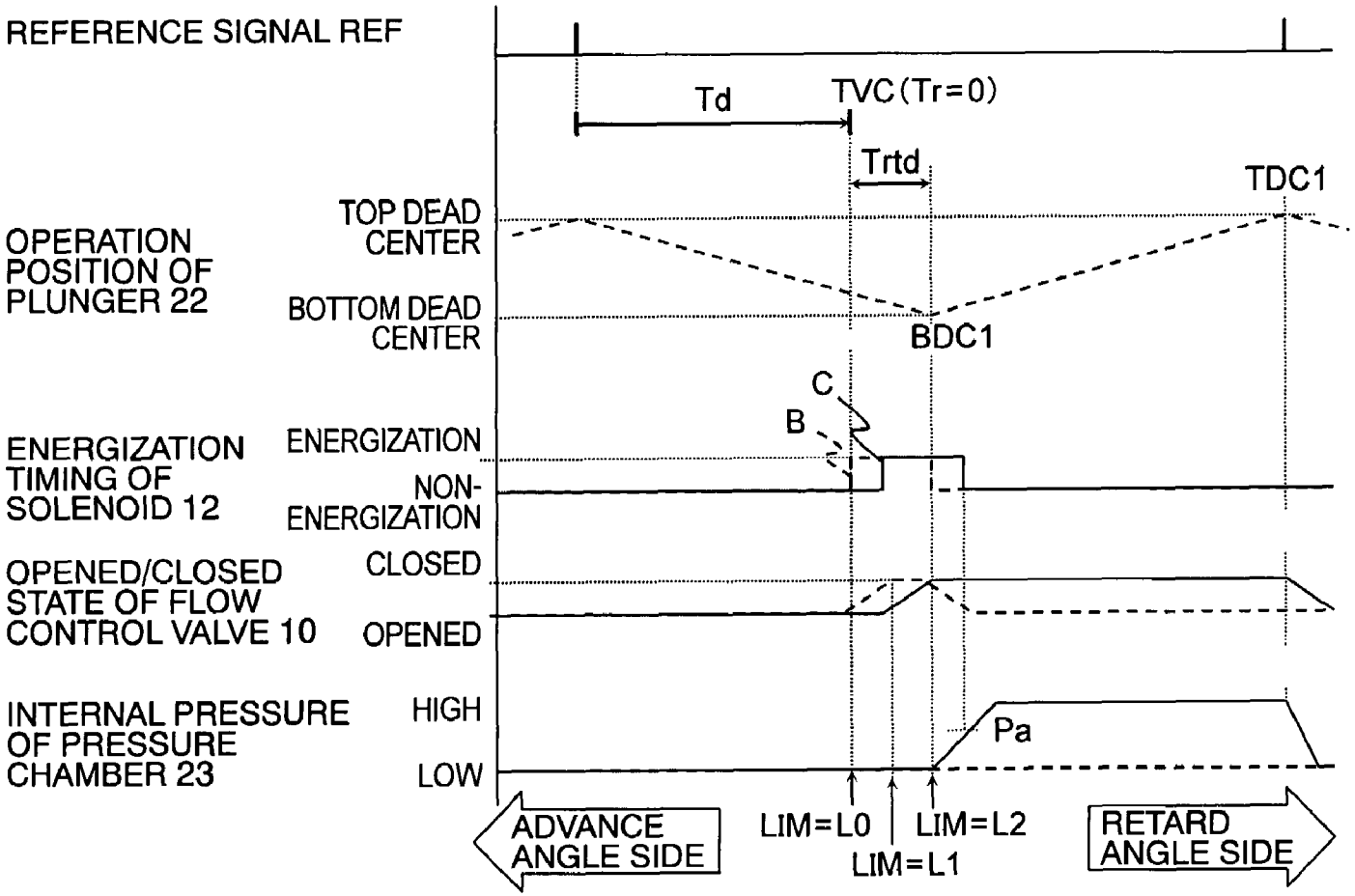
FIG. 6 is a timing chart supplementally explaining the operation of the first embodiment of the present invention.

In FIG. 6, the same or like parts or elements as those described before (see FIG. 11) are identified by the same symbols, and the operation position of the plunger 22 in the high pressure fuel pump 20 is shown as a plunger operation characteristic shifted to the retard angle side (broken line), similarly as described above.

In the prior art, in cases where the plunger operation position has been shifted to the retard angle side (see a broken line in FIG. 11), the solenoid is controlled to be energized with the advance angle limiting position LIM=L0 (i.e., a position of Tr=0) being made the closed position TVC when the maximum amount of fuel is controlled to be delivered, so the fuel sucked to the pressure chamber 23 is relieved to the low pressure passage 33 side, and not delivered to the accumulator 36.

In this case, the fuel pressure PF in the accumulator 36 does not coincide with the target pressure PO. In other words, the amount of fuel in the accumulator 36 decreases in accordance with the injection of the fuel by the fuel injection valves 39, so the fuel pressure PF in the accumulator 36 accordingly reduces. Such an abnormal condition can be detected based on the fact that the closed position TVC is being controlled to be limited to the advance angle limiting position LIM=L0, and that the fuel pressure PF does not show a tendency to coincide with the target pressure PO.

Figure 11:
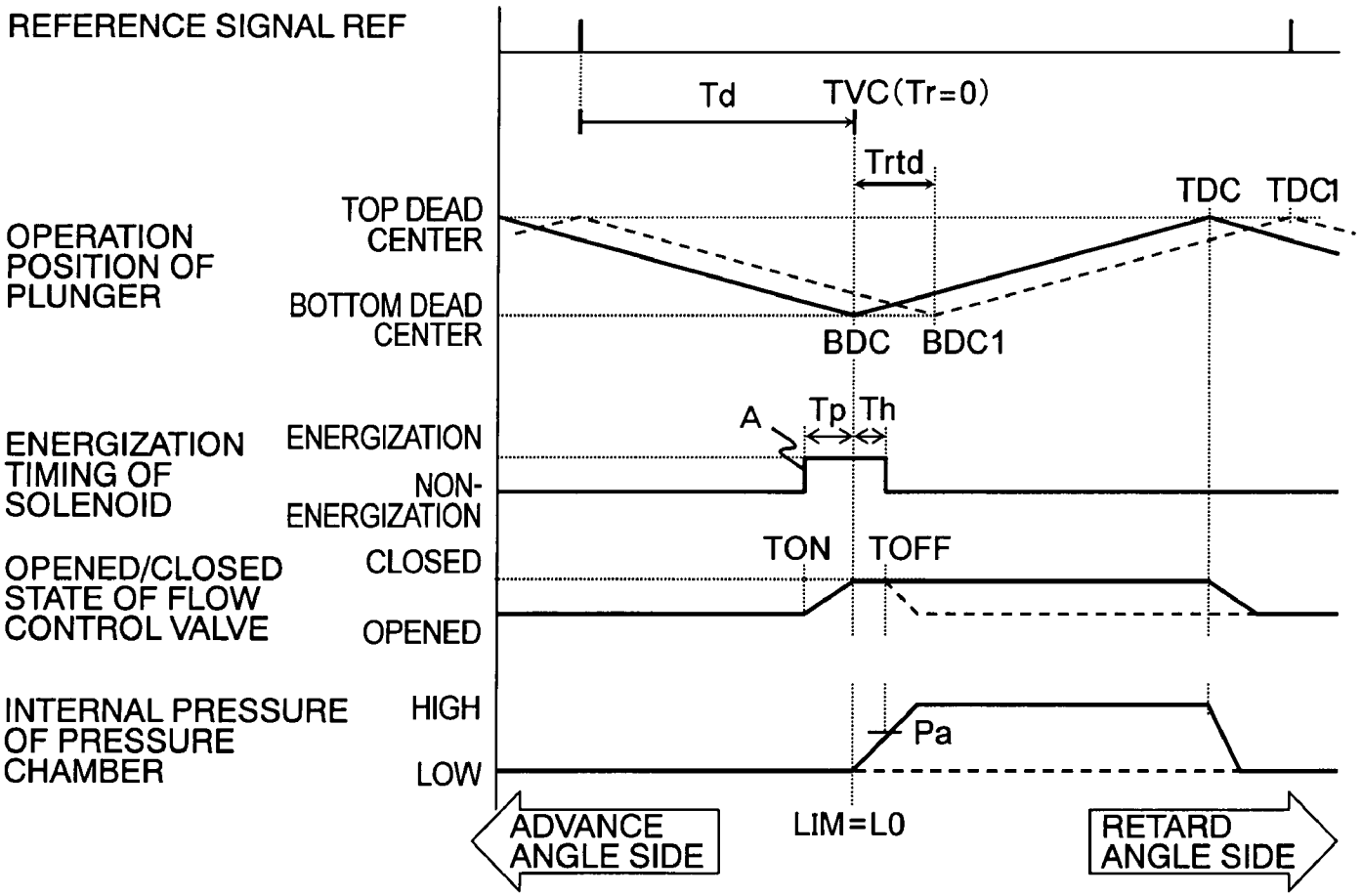
FIG. 11 is a timing chart illustrating problems in a conventional apparatus.

Accordingly, in the first embodiment of the present invention, first of all, like the energization operation (TON) of the solenoid 12 as shown by a solid line A in FIG. 11, an abnormal condition can be detected based on the fact that the closed position TVC is being controlled to be limited to the advance angle limiting position LIM=L0, and that the fuel pressure PF at this time does not show a tendency to coincide with the target pressure PO.

In addition, the advance angle limiting position LIM is changed from the initial value L0 to a position L1 at the retard angle side, and the solenoid 12 is controlled in accordance with an energization operation indicated by a broken line B in FIG. 6 while limiting the actual closed position TVC to the advance angle limiting position LIM=L1 after having been changed to the retard angle side.

Further, in case where the fuel pressure PF is not restored to the tendency to coincide with the target pressure PO in spite of the advance angle limiting position LIM having been changed to the position L1, the advance angle limiting position LIM is changed from the current position L1 to a more retarded position L2.

In this case, the solenoid 12 will be controlled in accordance with an energization operation indicated by a solid line C in FIG. 6 while limiting the advance angle limiting position LIM to the more retarded angle position L2.

Thus, by changing the advance angle limiting position LIM to the retard angle side up to the position L2, it becomes possible to ensure the energization holding time Th required for energization of the solenoid 12 after the closure of the flow control valve 10 in the ascending period of the plunger 22. As a result, the fuel pressure PF in the accumulator 36, decreasing until then, also starts rising so that it comes to show a tendency to coincide with the target pressure PO.

Next, supplementary reference will be made to the behavior of the fuel pressure PF in the above-mentioned operation while referring to FIGS. 6 and 11 together with a timing chart in FIG. 7.

Figure 7:
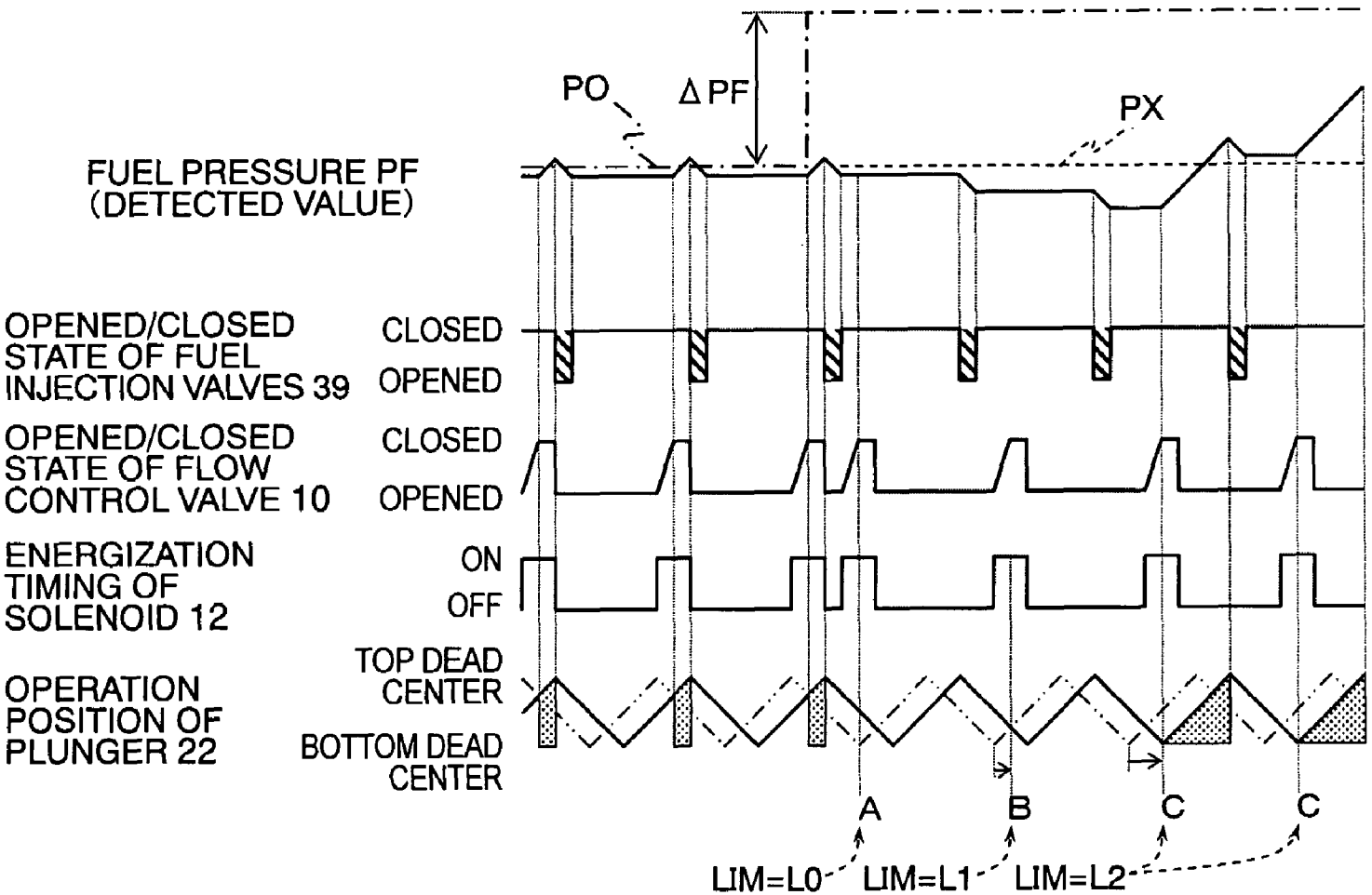
FIG. 7 is a timing chart supplementally explaining the behavior of fuel pressure in normal time in the first embodiment of the present invention.

FIG. 7 is a timing chart for explaining the operation of the advance angle limiting value change section 611 in the ECU 60, in which there are shown, in the order from the top to the bottom, the behaviors of the fuel pressure PF (detected value) in the accumulator 36 and the target pressure PO (alternate long and short dash line), the operations of the fuel injection valves 39 (a shaded portion indicating during. the injection of fuel), the opened/closed state of the flow control valve 10, the energization state of the solenoid 12, and the operation position of the plunger 22 in the high pressure fuel pump 20, respectively.

Here, note that, in FIG. 7, there are shown the behaviors at the time when the target pressure PO suddenly changes from a state in which the target pressure PO and the fuel pressure PF substantially coincide with each other (pressure deviation ΔPF≈0) to a high pressure side (i.e., states before and after a large pressure deviation ΔPF has taken place) as a result of a change in the operating condition of the engine 40. Also, the value of the fuel pressure PF immediately before the target pressure PO suddenly changes is used as a threshold value PX for the determination of change of the advance angle limiting position LIM. In addition, in the operation position of the plunger 22, an alternate long and two short dashes line represents a normal operation position, and a solid line represents an operation position when displaced to the retard angle side.

As shown in FIG. 7, when only the target pressure PO suddenly changes to the high pressure side from the state in which the target pressure PO and the fuel pressure PF substantially coincide with each other, a large pressure deviation ΔPF is generated.

At this time, the closed position TVC of the flow control valve 10 is controlled by being limited to the position of the initial value L0 of the advance angle limiting position LIM (the energization operation of the solenoid 12 indicated by the solid line A in FIG. 11) according to feedback control.

However, since the operation position of the plunger 22 (see the solid line) is displaced or deviated to the retard angle side from the normal position (see the alternate long and two short dashes line), fuel is not delivered to the accumulator 36, and the fuel pressure PF is lower than the threshold value PX.

Accordingly, in the following control cycle, the advance angle limiting position LIM is changed to the position L1 at the retard angle side from (or more retarded than) the initial value L0 (the energization operation of the solenoid 12 indicated by the broken line B in FIG. 6), and in the next following cycle, the advance angle limiting position LIM is changed to the position L2 at the retard angle side from (or more retarded than) the last retard side position Li (the energization operation of the solenoid 12 indicated by the solid line C in FIG. 6).

Thus, when the advance angle limiting position LIM is changed up to the position L2, the fuel pressure PF, having been only decreasing, starts to rise toward the target pressure PO, and finally comes to reach the target pressure PO.

In FIG. 7, in order to determine whether the advance angle limiting position LIM has been changed, the advance angle limiting position LIM is changed when the condition of PF<PX is satisfied by using the value of the fuel pressure PF immediately before the target pressure PO has suddenly changed as the threshold value PX, but such a change can instead be made when the condition is satisfied that the sign of the pressure deviation ΔPF (=PO−PF) continues to be negative for a predetermined time or more.

Next, a learning function of the ECU 60 will be described.

When the closed position TVC of the flow control valve 10 is being controlled to be limited to the advance angle limiting position which has been changed to a value at the retard angle side, and when the fuel pressure PF shows a tendency to coincide with the target pressure PO, as stated above, the ECU 60 stores, as a position deviation learning value, a positional deviation between the last and current values of the advance angle limiting position LIM (i.e., the advance angle limiting positions before and after the closed position of the flow control valve 10 has been changed to the value at the retard angle side, and controls, after the storage of the position deviation learning value, the closed position TVC of the flow control valve 10 as a value which is obtained by adding the position deviation learning value to the closed position set by the flow control valve control section.

That is, the ECU 60 learns the degree of deviation of the position of the plunger 22 as a "position deviation learning value" based on the fact that the fuel pressure PF comes to show a tendency to coincide with the target pressure PO after the advance angle limiting position LIM has been changed to the value at the retard angle side, and thereafter corrects the closed position TVC set by the flow control valve control section on the basis of the position deviation learning value.

In the above-mentioned example (see FIGS. 6 and 11), the degree of deviation of the operation position of the plunger 22, which can not be recognized by the ECU 60, is the positional difference (maximum amount of deviation) Trtd between the estimated bottom dead center BDC and the actual bottom dead center BDC1.

Accordingly, the ECU 60 detects, as a position deviation learning value, a positional deviation ΔLIM (=|L0−L2|) between the initial value L0 of the advance angle limiting position LIM and the advance angle limiting position L2 when the decreased or lowered fuel pressure PF starts to rise.

At this time, as will be clear from FIGS. 11 and 6, the positional difference (maximum amount of deviation) Trtd between the estimated bottom dead center BDC and the actual bottom dead center BDC1 is equal to the advance angle limiting position deviation ΔLIM (=|L0−L2|) when the fuel pressure PF is restored.

Accordingly, the ECU 60 stores the advance angle limiting position deviation ΔLIM as a position deviation learning value, and thereafter decides, as the closed position TVC, a value (=Tr+ΔLIM) which is obtained by adding the position deviation learning value ΔLIM to the first half period Tr, when the first half period Tr corresponding to the time (or angle) from the estimated bottom dead center BDC is decided.

Next, supplementary reference will be made to the operation of the abnormality diagnosis section 613 (steps S124 through S126) in the ECU 60 upon occurrence of an abnormality while referring to the timing chart of FIG. 8.

When the advance angle limiting position changed to the retard angle side reaches a value that is retarded from a predetermined abnormality determination value LX, the abnormality diagnosis section 613 determines that the fuel supply system is in an abnormality occurrence state, and sets the abnormality diagnosis flag FL3 to "1".

For example, the abnormality diagnosis flag FL3 is output to external equipment such as a warning part (not shown), etc., so that it serves to make the user to recognize the abnormality occurrence state and contribute to facilitating the restoration of the abnormal stafe.

Figure 8:
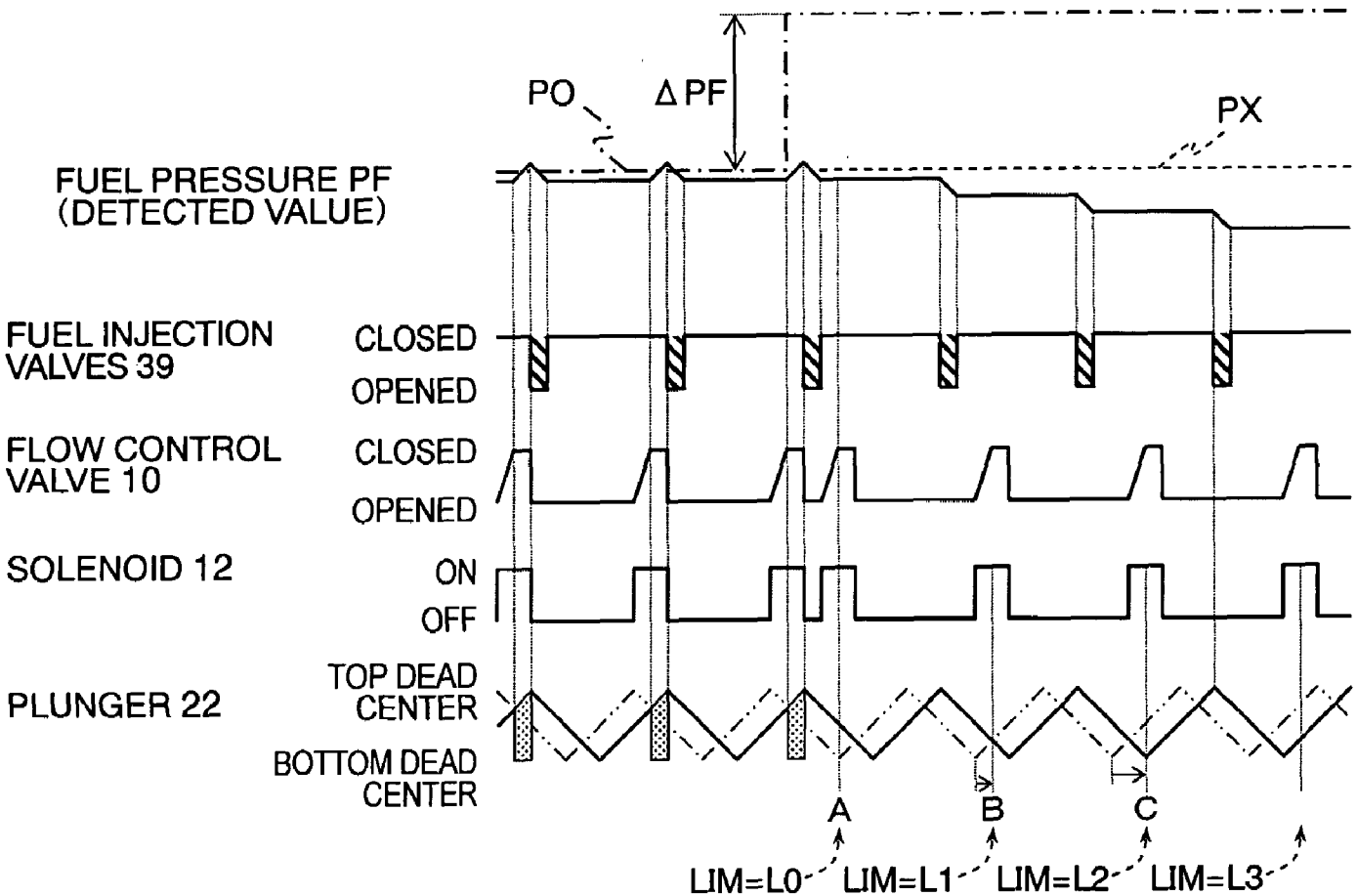
FIG. 8 is a timing chart supplementally explaining the behavior of fuel pressure in abnormal time in the first embodiment of the present invention.

FIG. 8 is a timing chart for explaining the operation of the abnormality diagnosis section 613, in which similar to FIG. 7, there are shown, in the order from the top to the bottom, the behaviors of the fuel pressure PF and the target pressure PO, the operations of the fuel injection valves 39, the opened/closed state of the flow control valve 10, the energization state of the solenoid 12, and the operation position of the plunger 22.

In addition, in FIG. 8, similar to FIG. 7, a normal operation position (alternate long and two short dashes line) and an operation position shifting to the retard angle side (solid line) of the plunger 22 are shown, and also there is shown a state in which the target pressure PO suddenly changes from the state that the fuel pressure PF substantially coincides with the target pressure PO to a high pressure side (a large pressure deviation ΔPF being generated).

However, FIG. 8 shows a case where abnormality has occurred in the fuel supply system, in which the fuel pressure PF continues decreasing without showing a tendency to coincide with the target pressure PO even if the advance angle limiting position LIM is changed to the retard angle side when the target pressure PO suddenly increases.

In FIG. 8, as previously stated, when only the target pressure PO suddenly changes to the high pressure side, a large pressure deviation ΔPF is generated, and the closed position TVC of the flow control valve 10 is controlled to be limited to the position of the initial value L0 of the advance angle limiting position LIM.

However, the operation position of the plunger 22 (see the solid line) is displaced or deviated to the retard angle side, so fuel is not delivered to the accumulator 36, and the fuel pressure PF is lower than the threshold value PX, as a result of which in the following control cycle, the advance angle limiting position LIM is changed to the position L1 at the retard angle side from the initial value L0, and is further changed to the more retarded side position L2.

When abnormality occurs in the fuel supply system, however, the fuel pressure PF only decreases but never increases or rises toward the target pressure PO even if the advance angle limiting position LIM is changed to the maximum retard angle side position L2, as shown in FIG. 8, so the advance angle limiting position LIM is changed to a position L3 more retarded than the maximum retard angle side position L2.

When the advance angle limiting position LIM is changed up to the position L3 more retarded than the maximum retard angle side position L2, it is found at that time that the positional deviation ΔLIM (=|L0−L3|) between the initial value L0 of the advance angle limiting position LIM and the current advance angle limiting position L3 has become larger than the maximum amount of deviation Trtd of the operation position of the plunger 22 that is normally assumed.

Accordingly, by setting beforehand the maximum degree of variation (maximum width of variation) Lrtd that can occur in normal time as an abnormality determination value LX, a determination can be made that abnormality occurs in the fuel supply system when the advance angle limiting position LIM has been changed to the position L3 at the retard angle side which can not occur in normal time.

As described above, the high pressure fuel pump control apparatus according to the first embodiment of the present invention includes the low pressure fuel pump 31 that draws up fuel in the fuel tank 30 and delivers it to the low pressure passage 33, the high pressure fuel pump 20 that sucks the fuel delivered from the low pressure fuel pump 31 into the pressure chamber 23 and delivers it therefrom, the normally open flow control valve 10 that is arranged in the fuel passage connecting between the low pressure passage 33 (or the fuel tank 30) and the pressure chamber 23, the delivery valve (check valve) 35 that is arranged in the high pressure passage 34 connecting between the pressure chamber 23 and the accumulator 36, the fuel injection valves 39 that supply the fuel in the accumulator 36 to the respective combustion chambers of the engine 40, the fuel pressure sensor 61 that detects the fuel pressure PF in the accumulator 36, the flow control valve control section (ECU 60) that controls the amount of delivery fuel Q of the high pressure fuel pump 20 by setting the closed position TVC of the flow control valve 10 so as to make the fuel pressure PF coincide with the target pressure PO which is decided in accordance with the operating condition of the engine 40, and the advance angle setting limiting section 606 that limits or prevents the closed position set by the flow control valve control section from being set to a location advanced from a predetermined advance angle limiting position to the advance angle side, wherein when the closed position TVC is controlled to be limited to the advance angle limiting position LIM, and when the fuel pressure PF does not show a tendency to coincide with the target pressure PO, the advance angle setting limiting section 606 changes the advance angle limiting position LIM from the last set value to a value more retarded than the last set value.

Thus, when the amount of delivery fuel Q of the high pressure fuel pump 20 is to be controlled to the maximum amount of delivery fuel QMAX, the fuel delivery control function can be quickly restored by detecting the occurrence of a situation in which delivery control becomes impossible due to variations related to position control, and changing the advance angle limiting position LIM to a value at the retard angle side. As a result, it is possible to alleviate or avoid the state that the fuel pressure PF in the accumulator 36 can not be maintained at the target pressure PO (i.e., the deterioration of drivability and/or the exhaust gas might be caused due to inability to obtain a desired combustion performance).

Also, when the closed position TVC of the flow control valve 10 is being controlled to be limited to the advance angle limiting position LIM which has been changed to a value at the retard angle side, and when the fuel pressure PF shows a tendency to coincide with the target pressure PO, the flow control valve control section in the ECU 60 stores, as a position deviation learning value, a positional deviation ΔLIM between the advance angle limiting positions before and after the closed position of the flow control valve 10 has been changed to the value at the retard angle side, and controls to correct, after storage of the position deviation learning value ΔLIM, the closed position TVC of the flow control valve 10 by adding the position deviation learning value ΔLIM thereto.

Thus, by storing, as the position deviation learning value ΔLIM, the amount of deviation of the operation position of the plunger 22 that can not be recognized by the ECU 60, and using the subsequent correction of the closed position TVC, it is possible to alleviate the load for the amount of feedback control of the closed position TVC upon occurrence of a deviation in the operation position of the plunger 22, whereby the response of the feedback control can be improved.

In addition, the ECU 60 further includes the abnormality diagnosis section 613 that determines the presence or absence of abnormality of the fuel supply system including the low pressure fuel pump 31, the high pressure fuel pump 20 and the flow control valve 10, and when the advance angle limiting position LIM changed to the retard angle side by the advance angle setting limiting section 606 reaches a value more retarded than the predetermined abnormality determination value LX, the abnormality diagnosis section 613 determines that the fuel supply system is in an abnormality occurrence state.

As a result, it is possible to detect an abnormal state in which there is a potential situation that the fuel pressure PF in the accumulator 36 becomes unable to be maintained at the target pressure PO, and to make the user recognize such a situation by informing it to the user.

Although reference has been made herein to the fuel supply system in which the flow control valve 10 is arranged between the low pressure passage 33 and the pressure chamber 23, it is needless to say that the present invention can be applied to a fuel supply system in which the flow control valve 10 is arranged between the fuel tank 30 and the pressure chamber 23, while achieving operational effects equivalent to those referred to above.

Embodiment 2

Though not particularly described in the above-mentioned first embodiment, the advance angle limiting position LIM may be automatically adjusted to the retard angle side under a predetermined condition by forcedly changing the closed position TVC of the flow control valve 10 to the advance angle limiting position LIM during the normal feedback control of the closed position TVC.

Hereinafter, reference will be made to a high pressure fuel pump control apparatus for an engine according to a second embodiment of the present invention.

For example, the above-mentioned control operation (see FIGS. 6 and 7) can not be executed until a large pressure deviation ΔPF is generated due to a change in the operating condition of the engine 40.

Accordingly, in the second embodiment of the present invention, even in an operating condition in which the closed position TVC of the flow control valve 10 is not controlled to be limited to the advance angle limiting position LIM, e.g., during a low load operation or in a condition in which a large pressure deviation ΔPF is not generated, the presence or absence of potential abnormality can be examined or detected by generating a large pressure deviation ΔPF in a forced manner.

The system configuration of the high pressure fuel pump control apparatus for an engine according to the second embodiment of the present invention is as shown in FIGS.

1 through 4, and is only different from the one according to the above-mentioned first embodiment in a part of the function of the ECU 60.

In this case, under the normal feedback control operation, i.e., when the closed position TVC is not controlled to be limited to the advance angle limiting position LIM, and when the fuel pressure PF shows a tendency to substantially coincide with the target pressure PO, the ECU 60 switches the closed position TVC to the advance angle limiting position LIM in a forced manner. When the fuel pressure PF does not show a predetermined rising tendency in spite of such a forced switching, the ECU 60 releases the forced switching thereby to restore the operation of the flow control valve 10 to the normal control operation after changing the advance angle limiting position LIM to a value at the retard angle side.

Now, reference will be made to the control operation of the high pressure fuel pump control apparatus for an engine according to the second embodiment of the present invention while referring to a flow chart in FIG. 9.

Figure 9:
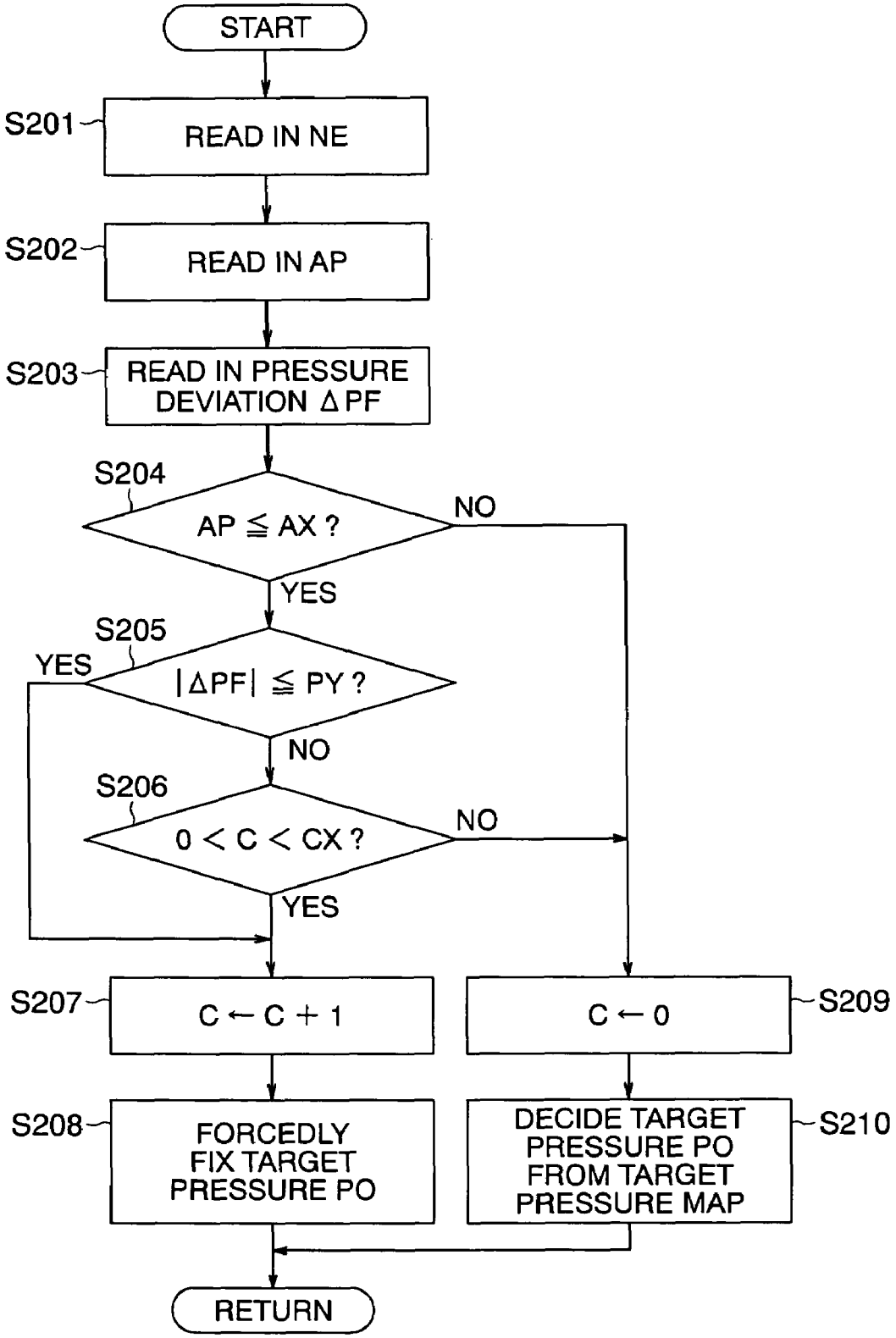
FIG. 9 is a flow chart illustrating the control operation of a second embodiment of the present invention.

Here, note that the control operation of FIG. 9 is achieved by the above-mentioned target pressure deciding function (see step S105 in FIG. 5), and hence steps S201 through S210 in FIG. 9 correspond to internal operations in the above-mentioned step S105.

In addition, it is assumed that in FIG. 9, the initial value of a counter C for controlling the time to continue the forced switching control is set to "0" beforehand.

First of all, similar to the above-mentioned steps S101, S104 and S107, the number of engine revolutions per minute NE is read in (step S201), the amount of accelerator pedal depression AP is read in (step S202), and the pressure deviation ΔPF is read in (step S203). Then, it is determined whether the amount of accelerator pedal depression AP is less than or equal to a predetermined value AX (i.e., AP≦AX) (step S204).

When it is determined as AP>AX in step S204 (that is, NO), the value of the counter C is cleared to zero (step S209), and the target pressure PO is decided based on the target pressure map 603 (step S210), whereafter the processing routine of FIG. 9 is exited.

On the other hand, when it is determined as AP≦AX in step S204 (that is, YES), it is subsequently determined whether the absolute value |ΔPF| of the pressure deviation ΔPF is less than or equal to a predetermined value PY (i.e., |ΔPF|≦PY) (step S205).

When it is determined as |ΔPF|≦PY in step S205 (that is, YES), the value of the counter C is incremented to "C+1" (step S207), and the target pressure PO is forcedly fixed to a predetermined value Pmax (step S208), whereafter the processing routine of FIG. 9 is exited.

On the other hand, when it is determined as |ΔPF|>PY in step S205 (that is, NO), it is subsequently determined whether the counter C is counting and whether the value of the counter C is less than a threshold value CX (0<C<CX) (step S206).

When it is determined as C=0 or C>CX in step S206 (that is, NO), the value of the counter C is cleared to zero (step S209), and the target pressure PO is decided based on the target pressure map 603 (step S210), whereafter the processing routine of FIG. 9 is exited.

On the other hand, when it is determined as 0<C<CX in step S206 (that is, YES), it is assumed that the counter C is counting, so the value of the counter C is incremented to "C+1" (step S207), and the target pressure PO is forcedly fixed to the predetermined value Pmax (step S208), whereafter the processing routine of FIG. 9 is exited.

As described above, according to the second embodiment of the present invention, when the amount of accelerator pedal depression AP is less than or equal to the predetermined value AX (AP≦AX), and when the absolute value |ΔPF| of the pressure deviation ΔPF become less than or equal to the predetermined value PX (i.e., |ΔPF|≦PX), the counter C starts incrementing (step S207), and the above-mentioned control operation (FIG. 5) is executed with the target pressure PO being forcedly fixed to the predetermined high pressure value Pmax over a period of time until the amount of accelerator pedal depression AP exceeds the predetermined value AX or until the counter C reaches the predetermined value CX.

Here, note that the reason for executing the forced control when the amount of accelerator pedal depression AP is less than or equal to the predetermined value AX (i.e., AP≦AX) is as follows. That is, by limiting the condition for execution of the forced control to an engine operating condition in which the amount of fuel injection required of the engine 40 is relatively small, it is possible to ensure a larger amount of fuel that is able to contribute to raising the fuel pressure PF in the accumulator 36 among the amount of fuel Q to be delivered when the target pressure PO has been changed.

As described in the foregoing, the ECU 60 (the flow control valve control section) according to the second embodiment of the present invention controls the flow control valve 10 in the following manner. That is, when the closed position TVC of the flow control valve 10 is not being controlled to be limited to the advance angle limiting position LIM, and when the fuel pressure PF shows a tendency to substantially coincide with the target pressure PO, the closed position TVC is forcedly switched to the advance angle limiting position LIM, and at the same time, when the fuel pressure PF does not show a predetermined rising tendency in spite of the closed position TVC having been forcedly switched to the advance angle limiting position LIM, the state of the closed position TVC being forcedly switched to the advance angle limiting position LIM is released and restored to the normal control state after the advance angle limiting position LIM has been changed to a value more retarded than the last set value.

As a result, even in the operating condition in which the closed position TVC is not controlled to be limited to the advance angle limiting position LIM, e.g., during a low load operation or in a condition in which a large pressure deviation ΔPF is not generated, the presence or absence of the potential abnormality of a situation in which delivery control becomes impossible can be checked by generating the large pressure deviation ΔPF in a forced manner, so it becomes able to detect, at an early time, the occurrence of a situation in which fuel delivery control becomes impossible.

While the invention has been described in terms of preferred embodiments, those skilled in the art will recognize that the invention can be practiced with modifications within the spirit and scope of the appended claims.

What is claimed is:

1. A high pressure fuel pump control apparatus for an engine comprising:

a variety of kinds of sensors that detect an operating condition of an engine;

a low pressure fuel pump that draws up fuel in a fuel tank and delivers it to a low pressure passage;

a high pressure fuel pump that sucks the fuel delivered from said low pressure fuel pump into a pressure chamber and delivers it therefrom;

a normally open flow control valve that is arranged in a fuel passage connecting said pressure chamber and either one of said fuel tank and said low pressure passage;

a delivery valve that is arranged in a high pressure passage connecting between said pressure chamber and an accumulator;

fuel injection valves that supply the fuel in said accumulator to respective combustion chambers of said engine;

a fuel pressure sensor that detects the pressure of fuel in said accumulator and outputs the value of the fuel pressure thus detected;

a flow control valve control section that controls an amount of delivery fuel of said high pressure fuel pump by setting a closed position of said flow control valve; and an advance angle setting limiting section that limits said closed position from being set to a location advanced from a predetermined advance angle limiting position to an advance angle side;

wherein said flow control valve control section decides a target pressure in accordance with the operating condition of said engine, and sets said closed position in such a manner that said detected fuel pressure value coincides with said target pressure; and when said closed position is being controlled to be limited to said advance angle limiting position, and when said detected fuel pressure value does not show a tendency to coincide with said target pressure, said advance angle setting limiting section changes said advance angle limiting position from the last set value to a value more retarded than said last set value.

2. The high pressure fuel pump control apparatus for an engine as set forth in claim 1, wherein when said closed position is not being controlled to be limited to said advance angle limiting position, and when said detected fuel pressure value shows a tendency to substantially coincide with said target pressure, said flow control valve control section forcedly switches said closed position to said advance angle limiting position; and when said detected fuel pressure value does not show a predetermined rising tendency in spite of said closed position having been forcedly switched to said advance angle limiting position, said flow control valve control section releases the state of said closed position being forcedly switched to said advance angle limiting position and restores it to a normal control state after changing said advance angle limiting position to a value more retarded than the last set value.

3. The high pressure fuel pump control apparatus for an engine as set forth in claim 1, wherein when said closed position is being controlled to be limited to said advance angle limiting position which has been changed to a retard angle side value, and when said detected fuel pressure value shows a tendency to coincide with said target pressure, said flow control valve control section stores, as a position deviation learning value, a positional deviation between advance angle limiting positions before and after changed to said retard angle side value, and controls to correct, after storage of said position deviation learning value, said closed position of said flow control valve by adding said position deviation learning value thereto.

4. The high pressure fuel pump control apparatus for an engine as set forth in claim 1, further comprising an abnormality diagnosis section that determines the presence or absence of abnormality of a fuel supply system including said low pressure fuel pump, said high pressure fuel pump and said flow control valve;

wherein when said advance angle limiting position changed to a retard angle side by said advance angle setting limiting section reaches a value retarded from a predetermined abnormality determination value, said abnormality diagnosis section determines that said fuel supply system is in an abnormality occurrence state.

* * * * *